US011192045B2

(12) United States Patent
Derusha

(10) Patent No.: US 11,192,045 B2
(45) Date of Patent: Dec. 7, 2021

(54) CONSTRUCTION OF FASHION ACCESSORIES BY ASSEMBLY OF SONOBE UNITS

(71) Applicant: Joseph Derusha, Sherman Oaks, CA (US)

(72) Inventor: Joseph Derusha, Sherman Oaks, CA (US)

( * ) Notice: Subject to any disclaimer, the term of this patent is extended or adjusted under 35 U.S.C. 154(b) by 139 days.

(21) Appl. No.: 15/122,077

(22) PCT Filed: Feb. 26, 2015

(86) PCT No.: PCT/US2015/017831

§ 371 (c)(1),
(2) Date: Aug. 26, 2016

(87) PCT Pub. No.: WO2015/130972

PCT Pub. Date: Sep. 3, 2015

(65) Prior Publication Data

US 2017/0072333 A1 Mar. 16, 2017

Related U.S. Application Data

(60) Provisional application No. 61/944,975, filed on Feb. 26, 2014.

(51) Int. Cl.
*A63H 33/16* (2006.01)
*A44C 25/00* (2006.01)
(Continued)

(52) U.S. Cl.
CPC ..... *A63H 33/16* (2013.01); *A41D 25/001* (2013.01); *A41D 25/005* (2013.01); *A44C 25/00* (2013.01);
(Continued)

(58) Field of Classification Search
CPC ..... A44C 27/00; A44C 25/001; A44C 25/007; A63H 33/16; Y10T 29/49588; Y10T 29/4959; Y10T 29/49597
See application file for complete search history.

(56) References Cited

U.S. PATENT DOCUMENTS

D115,548 S 7/1939 Goldsmith
D131,189 S 1/1942 Lewis
(Continued)

FOREIGN PATENT DOCUMENTS

CA 2433990 A1 * 1/2005 ..... E02B 3/108
JP 2008018958 A * 1/2008
WO 2015130972 A2 9/2015

OTHER PUBLICATIONS

Rubikscube907, Jul. 26, 2011, How to Make Origami Cube Earrings, https://www.youtube.com/watch?v=RskT9dQ2518 (Year: 2011).*
(Continued)

*Primary Examiner* — Jason L Vaughan
(74) *Attorney, Agent, or Firm* — Nixon Peabody LLP; Linda B. Huber

(57) ABSTRACT

Describe herein are methods of constructing fashion accessories using modular origami folding techniques adapted to incorporate a broad range of flexible material. By incorporating and adapting modular origami units, such as Sonobe units, a variety of fashion accessories can be produced. Improved methods of assembling such units into including fashion accessories, further incorporate attachment mechanisms to allow for more robust construction in a fixed and durable state. A variety of fashion accessory designs produced by the described processes are presented.

16 Claims, 23 Drawing Sheets

(51) Int. Cl.

| | |
|---|---|
| ***A44C 27/00*** | (2006.01) |
| ***A45C 3/00*** | (2006.01) |
| ***A41D 25/00*** | (2006.01) |
| ***A45C 1/02*** | (2006.01) |
| ***A45C 1/06*** | (2006.01) |
| ***A45C 3/02*** | (2006.01) |
| ***A45C 3/04*** | (2006.01) |
| ***A45C 5/02*** | (2006.01) |
| ***A45C 11/00*** | (2006.01) |
| ***A45C 11/16*** | (2006.01) |
| ***A45C 11/18*** | (2006.01) |
| ***A45C 11/32*** | (2006.01) |
| ***A45F 3/04*** | (2006.01) |
| ***A41D 15/00*** | (2006.01) |

(52) U.S. Cl.

CPC ..... *A44C 27/00* (2013.01); *A45C 1/02* (2013.01); *A45C 1/06* (2013.01); *A45C 3/001* (2013.01); *A45C 3/02* (2013.01); *A45C 3/04* (2013.01); *A45C 5/02* (2013.01); *A45C 11/00* (2013.01); *A45C 11/16* (2013.01); *A45C 11/18* (2013.01); *A45C 11/32* (2013.01); *A45F 3/04* (2013.01); *A41D 15/00* (2013.01); *A45C 2011/002* (2013.01); *A45C 2011/003* (2013.01)

(56) References Cited

U.S. PATENT DOCUMENTS

| | | | | |
|---|---|---|---|---|
| D137,556 | S | 3/1944 | Meyers | |
| 3,878,638 | A * | 4/1975 | Benjamin | A63H 33/16 428/187 |
| 4,033,068 | A * | 7/1977 | Skillman | A63H 33/16 428/542.2 |
| 4,327,516 | A * | 5/1982 | Lubozynski | A63H 33/16 428/12 |
| 4,976,652 | A * | 12/1990 | Schwartz | A63H 33/04 273/157 R |
| 5,171,014 | A * | 12/1992 | Hsieh | A63F 9/12 273/157 R |
| 5,422,158 | A * | 6/1995 | Cheng | A63F 9/088 428/126 |
| 5,489,230 | A * | 2/1996 | Gavula, Jr. | A63H 33/16 428/33 |
| 6,379,212 | B1 * | 4/2002 | Miller | A63H 33/084 446/85 |
| 6,921,314 | B2 * | 7/2005 | Miller | A63H 33/084 446/487 |
| D596,849 | S | 7/2009 | Billauer | |
| 7,818,898 | B1 * | 10/2010 | Orengo | A43B 1/0072 36/45 |
| D663,117 | S | 7/2012 | Schiffman | |
| D665,575 | S | 8/2012 | Bouskill | |
| D712,138 | S | 9/2014 | Kao | |
| D715,540 | S | 10/2014 | Ghisellini | |
| D757,425 | S | 5/2016 | Derusha | |
| D774,299 | S | 12/2016 | Anderson | |
| 9,814,286 | B2 * | 11/2017 | Clawson | A44C 7/002 |
| 9,878,260 | B1 * | 1/2018 | Chen | A63H 33/16 |

OTHER PUBLICATIONS

Bonnie32002, origami purse folding instructions Jan. 20, 2009, retrieved from pintrest on Nov. 5, 2019 (Year: 2009).*

Origamite—Origami Video Instructions, Modular Origami Box with Lid Instructions (Tomoko Fuse), Mar. 17, 2014, https://www.youtube.com/watch?v=VMH-vvlbHy4 (Year: 2014).*

Origami Instructions, Origami Sonobe Octahedral Unit, Jan. 29, 2013, https://www.youtube.com/watch?v=_8ftAKXZ2Rc&list=PL3F579F2D94BEB6EE&index=22&t=220s (Year: 2013).*

Origami-Instructions.com, Origami Fancy Basket, Mar. 19, 2012 https://web.archive.org/web/20120319032059/http://www.origami-instructions.com/origami-fancy-basket.html (Year: 2012).*

Releve Design. Flow to make small octahedral origami accessories. Retrieved from Internet: <http://www.relevedesign.com/how-to-make-origami-accessories/> Dec. 29, 2011.

Paper N Pearlz. Diamond Earrings. Retrieved from Internet: <http://papernpearlz.com/origami/diamond-earrings/> Mar. 30, 2010.

Origami Sonobe Cube Charms timelapse. Uploaded by SecretPsychoRo, Mar. 15, 2015. Retrieved from Internet: <http://www.youtube.com/watch?v=YCMwKbvRkoQ> on Apr. 30, 2015.

PCT/US2015/017831 International Search Report and Written Opinion dated Jun. 19, 2015; 9 pages.

International Preliminary Report on Patentability of related PCT Application (Application No. PCT/US2015/017831, =filed Feb. 26, 2015. NP Ref.: 099642-005117WO00); dated Aug. 30, 2016.

Notice of Allowance of Design U.S. Appl. No. 29/561,284, dated Dec. 5, 2017, 7 Pages.

Notice of Allowance of Design U.S. Appl. No. 29/561,290, dated Nov. 14, 2017, 12 Pages.

Notice of Allowance of Design U.S. Appl. No. 29/561,295, dated Nov. 14, 2017, 11 Pages.

Notice of Allowance of Design U.S. Appl. No. 29/561,383, dated Nov. 14, 2017, 11 Pages.

* cited by examiner

CONSTRUCTION OF FASHION ACCESSORIES BY ASSEMBLY OF SONOBE UNITS

CROSS-REFERENCE TO RELATED APPLICATIONS

This application is a National Phase of International Application No. PCT/US2015/017831 filed Feb. 26, 2015, which designated the U.S. and that International Application was published under PCT Article 21(2) in English, which claims priority under 35 U.S.C. § 119(e) to U.S. provisional patent application No. 61/944,975 filed Feb. 26, 2014, the entirety of which is hereby incorporated by reference.

FIELD OF THE INVENTION

This invention relates to fashion accessories produced by assembling one or more Sonobe units and methods to construct the fashion accessories.

BACKGROUND

A Sonobe unit is a type of modular origami typically made from folding a square sheet of paper material into a parallelogram-like shape. Each modular Sonobe unit contains a set of substantially triangular planar surfaces within a square that can be juxtaposed with another triangular plane from a different Sonobe unit to approximate contiguous surfaces among multiple connected units. Attachment of traditional Sonobe units is achieved by the modular Sonobe unit with a parallelogram-like shape possessing two extension points, and two pockets, the extension point being an acute angle of the parallelogram forming an outward extending triangular shape capable of being "tucked" into itself or the pocket of an adjacent Sonobe unit. Attachment using extension points and pockets conceals the outward extending triangular shape, allowing for presentation of the remaining triangular plane of the Sonobe unit. These triangular planes in combination allow for construction of many different varieties of polyhedral geometric shapes by approximating a contiguous surface. By folding and joining each Sonobe unit to other units and through this interconnection of Sonobe units, the triangular planes of Sonobe units forming a versatile number of polyhedral faces.

In spite of this versatility for generating multiple geometric shapes by interconnecting modular Sonobe origami units, there are significant limitations in producing a fashion accessory that has easy accessibility for inserting various articles or sufficient stability for carrying those articles. For example, the traditional technique of joining of multiple Sonobe units by "tucking" in extension points of each Sonobe unit into pockets of other Sonobe units does not produce designs capable of carrying articles weighing more than a few ounces, or result in enclosed three-dimensional spaces with significant limitations in access for inserting articles into the modular three-dimensional construction. Beyond these limitations of traditional folding techniques, choice of materials, such as Sonobe units traditionally made of paper, does not allow for durable and rigid construction that may be required for a fashion accessory.

Described herein is an improved method of assembling Sonobe units, including fashion accessories, wherein improved assemblies allow for more robust construction in a fixed and durable state.

SUMMARY OF THE INVENTION

Described herein is a method for constructing a fashion accessory, including providing one or more Sonobe units, and assembling the one or more Sonobe units to construct a fashion accessory, wherein assembly of the one or more Sonobe units includes insertion of an extension point from at least one Sonobe unit into the pocket of a Sonobe unit. In another embodiment, insertion of an extension point from at least one Sonobe unit into the pocket of a Sonobe unit includes at least two different Sonobe units adjacent to one another, the extension point and pocket being formed by different Sonobe units. In another embodiment, insertion of an extension point from at least one Sonobe unit into the pocket of a different Sonobe unit is repeated at least two, three, four, five, six, seven, eight, nine, ten, eleven, twelve, thirteen, fourteen, fifteen, sixteen, seventeen, eighteen, nineteen, twenty or more times. In another embodiment, at least two different Sonobe units includes two, three, four, five, six, seven, eight, nine, ten, eleven, twelve, or more Sonobe units. In another embodiment, at least two different Sonobe units are assembled to form at least two identical sub-assemblies, and the at least two identical sub-assemblies are further assembled to construct the fashion accessory. In another embodiment, folding of one or more substantially square materials into a Sonobe unit to provide the one or more Sonobe units. In another embodiment, the one or more Sonobe units are each made of a flexible material capable of maintaining a fold, selected from the group consisting of leather, fabric, plastic, sheet metal, paper and cardboard. In another embodiment, the at least two different Sonobe units comprise one or more Sonobe units of a particular color. In another embodiment, the at least two different Sonobe units comprise one or more Sonobe units of a particular material. In another embodiment, the at least two different Sonobe units comprise one or more Sonobe units of a particular pattern. In another embodiment, the method further including: configuring the fashion accessory to possess one or more colors, one or more materials, one or more patterns, at one or more predetermined locations on the fashion accessory. In another embodiment, the method further including: fixing one or more means for attachment to the fashion accessory. In another embodiment, the means for attachment includes stitching, gluing, pins, snaps, and/or grommets. In another embodiment, fixing one or more means for attachment includes fixing at a position wherein one or more Sonobe units are co-planar. In another embodiment, the method further includes attaching one or more ornamental features to the fashion accessory. In another embodiment, one or more ornamental features includes straps, handles, belts, hooks, or wheels onto the fashion accessory.

Also described herein is a fashion accessory, produced by a process including: providing one or more Sonobe units; and assembling one or more Sonobe units to construct the fashion accessory, wherein assembly of one or more Sonobe units includes insertion of an extension point from at least one Sonobe unit into the pocket of a Sonobe unit. In another embodiment, insertion of an extension point from at least one Sonobe unit into the pocket of a Sonobe unit includes at least two different Sonobe units adjacent to one another, the extension point and pocket being formed by different Sonobe units. In another embodiment, insertion of an extension point from at least one Sonobe unit into the pocket of a different Sonobe unit is repeated at least two, three, four, five, six, seven, eight, nine, ten, eleven, twelve, thirteen, fourteen, fifteen, sixteen, seventeen, eighteen, nineteen, twenty or more times. In another embodiment, at least two different Sonobe units includes two, three, four, five, six, seven, eight, nine, ten, eleven, twelve, or more Sonobe units. In another embodiment, the process further includes fixing one or more means for attachment at a position wherein one or more Sonobe units are co-planar. In another embodiment, the means for attachment includes stitching, gluing, pins, snaps, and/or grommets. In another embodiment, one or more Sonobe unit is constructed from a flexible material capable of maintaining a fold. In another embodiment, the flexible material is selected from the group consisting of leather, fabric, plastic, sheet metal, paper, and cardboard. In another embodiment, the fashion accessory has at least two colors, one or more materials, or one or more patterns. In another embodiment, the fashion accessory has one or more straps, handles, belts, hooks, wheels, or any combination thereof attached onto the fashion accessory. In another embodiment, the fashion accessory has a plurality of configurable multiple geometric arrangements adapted to at least two different shapes by a user. In another embodiment, the fashion accessary is a wallet, clutch, purse, handbag, briefcase, luggage, backpack, shopping bag, jewelry, make-up kit, holster, or bow tie.

Further described herein is a fashion accessory, produced by a process including: providing one or more Sonobe units; assembling one or more Sonobe units by inserting an extension point from at least one Sonobe unit into the pocket of a different adjacent Sonobe unit, and repeating the insertion among the one or more Sonobe units; and fixing one or more means for attachment at a position wherein one or more Sonobe units are co-planar.

BRIEF DESCRIPTION OF THE FIGURES

Exemplary embodiments are illustrated in referenced figures. It is intended that the embodiments and figures disclosed herein are to be considered illustrative rather than restrictive.

DESCRIPTION OF THE INVENTION

Figure 1A:
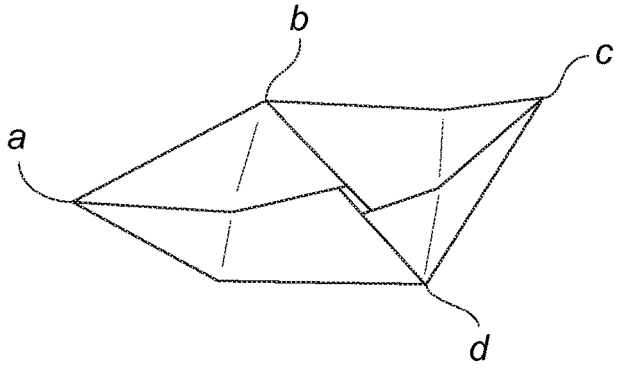
FIGS. 1A-1E depict an exemplary modular Sonobe unit with folding demonstrating the construction of a fashion accessory with a compartment for storage, with a reversibly open and closing top portion.

This instant invention described herein relates to fashion accessories produced by assembling one or more Sonobe units and methods of constructing the fashion accessories by addressing significant limitations present with existing methods and models.

"Fashion accessories for carrying various articles" and/or "fashion accessory for carrying various articles" as used herein refer to any fashion accessories produced by assembling one or more Sonobe units for carrying various articles, including coins, business cards, wallets, keys, books, mobile phones, laptops, tablet computers, gloves, clothes, scarves, make-up cosmetics, jewelry, and any other item that a user may desire. Forms of the fashion accessories include a wallet, clutch, purse, handbag, briefcase, luggage, backpack, shopping bag, jewelry, make-up kit, holster, bow tie, and other forms of the fashion accessories as they will be readily appreciated by those skilled in the art for carrying various articles. Features of some fashion accessories include configurable multiple geometric arrangements in each fashion accessory and adapted to different shapes of each fashion accessory by a user.

"Customized Sonobe unit" as used herein refers to a modular origami having a substantially parallelogram-like shape that can be customized when using a selection of a broad range of flexible material that is configurable and enhanced to support weight of articles for carrying or wearing fashion accessories created by methods set forth herein. A broad range of selected flexible materials includes leather, fabric, plastic, sheet metal, paper, cardboard, any combination thereof, and any other sufficiently flexible and configurable material readily recognized by those skilled in the art.

"Attachment" or "Attachment mechanism" as used herein refers to any form of affixing at one or more locations where the selected flexible material has been folded within each Sonobe unit or attaching at one or more locations where Sonobe units are interconnected to provide enhanced support and stability to the fashion accessories for enclosing various articles therein, carrying, or wearing the fashion accessories. Non-limiting examples of the attachment mechanism include stitches, adhesive glue, snap, pins, grommets, or attached through other means as will be readily appreciated by those of skilled in the art.

Fashion accessories, such as wallets, purses, clutches, or handbags can be sought for a wide variety of functions and occasions. While there are numerous designs and materials for fashion accessories that exist to satisfy user demands for different occasions or attire, incorporating design elements or construction inspired by the ancient Japanese paper folding technique, origami (from ori meaning "folding", and kami meaning "paper"), have been severely lacking. This may be due in part to the focus of origami on use of paper as a traditional material of choice, paper being a material of limited durability and insufficient rigidity, particularly for accessories that may be carrying contents. Yet origami folding technique is notable for allowing the generation of many intricate designs, as achieved by a small number of folds made in a material. Modular construction also provides opportunities for incorporation of different colors, prints or patterns into the resulting fashion accessory. Origami principles have been used in medical stents, packaging, engineering applications and mathematical modeling. But as any flat material capable of holding a crease could be used to practice various origami folding designs, fashion designs appear ripe to benefit from the unique aesthetic and construction design presented by origami folding.

Described herein are methods of constructing fashion accessories using modular origami folding techniques adapted to incorporate a broad range of flexible material that is configurable and, at least in some embodiments, can support weight of articles for carrying. In particular, the fashion accessories described herein rely on modular origami folding techniques in which a plurality of modular units, primarily identical modular units, are assembled together to form a complete model. This includes the aforementioned modular origami folding technique using Sonobe units. These modular origami units of parallelogram-like shape, each include multiple points and pockets, the points of one Sonobe unit capable of being inserted into the pocket of an adjacent Sonobe unit, establishing a contiguous surface between the surfaces of adjacent Sonobe units, with an attachment point in-between. The basic principles and techniques underlying modular origami folding with the Sonobe have been well-established since their original description by Toshie Takahama and Mitsunobu Sonobe of the Sosaku Origami Group 67 and its related publications. Each modular Sonobe unit contains a set of substantially triangular planar surfaces within a middle square that can be juxtaposed with another triangular plane from a different Sonobe unit to approximate contiguous surfaces among multiple connected units. Attachment of traditional Sonobe units is achieved by the modular Sonobe unit possessing a parallelogram-like shape possessing two extension points, and two pockets, the extension point being an acute angle of the parallelogram forming an outward extending triangular shape capable of being "tucked" into itself or the pocket of an adjacent Sonobe unit.

More specifically, a Sonobe unit is a type of flat origami that when constructed in assembly with other flat origami Sonobe units, can allow for modular construction of polyhedron, a three-dimensional hollow "solid" resulting from the joined edges of many different polygons. A traditional Sonobe unit has three core features allowing for polyhedron constructions: (1) a unit must have two extension points (2) a unit must have two pockets (3) an extension point must be able to fit within a pocket. The classic Sonobe unit is a parallelogram with approximately 45 and 135 degree angles, in a parallelogram-like shape, divided by folds into the two outward extending points (i.e., diagonal tabs at the ends), and two pockets within the center square. The extension points are derived from the acute angle of the parallelogram-like shape. Importantly, the acute angle of the extension points allows insertion of the points from one Sonobe into the pocket of a second Sonobe unit, while also juxtaposing the squares and their substantially triangular planes of neighboring Sonobe units. This arrangement is formation of polyhedra (three dimensional solid with straight faces and edges).

A simple polyhedral, a cube, is formed by six Sonobe units. For example, three interconnected Sonobe units can form an open bottom triangular pyramid of all isosceles right triangular faces with an apex point (i.e., right-angle apex of the pyramid). Combination of two sets of the three interconnected open bottom triangular pyramid allows formation of a cube. The first apex point, right-angle apex forms one corner of the cube, the second apex point (i.e., second right-angle apex) forms a second corner of the cube opposite of the first, with three tabs protruding from the first open bottom triangular pyramid inserted into the pockets of the second open bottom triangular pyramid to form the planar walls of the cube, thereby forming third and fourth apex points in a cube from their assembly. Illustration of this simple cube design demonstrates that the center diagonal fold of each Sonobe unit can replace a notional edge of a deltahedron (polyhedral with faces of equilateral triangles). The various faces of the triangular pyramid provide the equilateral triangle face elements in the deltahedron. For example, 6 Sonobe units for the aforementioned cube. The assembly of Sonobe units follows the geometrical principle of a regular polyhedral, where Vertices(V)−Edges(E)+Faces (F)=2. In the cube example, a cube has 8 vertices, 12 edges, and 6 faces (i.e., 8−12+6=2 . . . 8−12=−4 . . . −4+6=2). Using Sonobe units, 4 points (formed from two sets of 3 Sonobe units assembled together in the above example, to make 4 points in a cube) can be formed from 6 papers used. A further resulting property from the above assembly is that any given polyhedron is therefore n-colorable, if there is a way to construct the polyhedral from n different colored Sonobe units where no Sonobe units of the same color are inserted into each other.

An extension of the above described principle is that a variety of polyderal and deltahedral shapes can be assembled from a plurality of Sonobe units. The described assembly of pyramidal modules to form a cube further can demonstrate the relationship between number of Sonobe units used and the resulting polyhedral. Specifically, in geometrical terms, elevation is the extension of a vertex from the center of the face of a polyhedra and the addition of a triangular pyramid from the underlying face of center origin. Addition of the pyramidal shape to the underlying polyhedra means there are always 3 times as many faces in an elevated polyhedral compared as the underlying polyhedral. Because each Sonobe unit contributes two isosceles triangles to the polyhendra, one and a half times as many Sonobe units are needed for an underlying polyhedral design. This is shown is the simplest examples wherein the elevation of a isosceles right triangle pyramid, such as the above described pyramid shapes, is a cube. As a result, an elevated octahedral requires 12 Sonobe units, and an icosahedron requires 30 Sonobe units.

The above geometrical rules govern methods assemblies relying on Sonobe unit folding, including methods incorporating a variety of different flexible materials. In some embodiments, the flexible material is sufficiently flexible so as to be foldable into Sonobe units and configurable into fashion accessories, while being sufficiently rigid so as to maintain its shape once configured into a fashion accessory by the processes set forth herein. Non-limiting examples of selected flexible materials are leather, synthetic and non-synthetic fabrics, mixtures of said fabrics, plastic, sheet metal, paper, cardboard, and any combination thereof. Furthermore, the invention includes unique fashion accessories produced by assembling one or more customized Sonobe units, wherein each customized Sonobe unit for example may be secured by stitches, adhesive glue, snaps, or pins, fastened by one or more grommets, or attached through other means as will be readily appreciated by those ordinary skill in the art. Other aspects of the invention include techniques for embodying configurations of fashion accessories to display specifically targeted regions of colors, patterns, art designs, logos, or other depictions and aesthetic features on a flexible material at one or more predetermined locations on the fashion accessories. Some other aspects of the invention include methods for assembling one or more Sonobe units into a fashion accessory that is configurable in multiple geometric arrangements and adapted to different shapes of the fashion accessory by a user. A significant advantage of the described modular construction technique includes the ability to rely on a core sub-assembly unit (e.g., Sonobe unit) to assemble a variety of different constructions. Whereas other manufacturing processes may rely on one or more custom built template pieces to produce a single fashion accessory (e.g., handbag, wallet, etc.), here, the core units that are assembled in the resulting constructions can be identical, or substantially identical, thereby providing significant advantages in manufacturing scale-up ability, reduction in supply chain and inventory issues. Additionally, because the underlying sub-assembly unit in some cases (e.g., Sonobe unit) is a square, substantially square, rectangular or other geometric shaped material, the manufacturing costs on-demand of particular units is reduced, both in terms of simplicity of manufacturing and sizing-up of different fashion accessory construction sizes. For example, large square pieces of material can be utilized in a large handbag, but if those same square pieces of material are multiply bi-sected into smaller square pieces, one can construct a small handbag of variable dimension. Uniquely, a range of dimensionality can be achieved by the described assembly method. Approximately, a square Sonobe unit of X surface area will present a resulting triangle face of 1/16 X. As a result, the surface area of a desired constructed fashion accessory, being composed of multiple triangle faces, can be approximated by measuring resulting surface areas, approximating such surface areas into a plurality of equilateral triangle faces, the associated surface area of material used for construction will be a multiple of 16 and proportional to the number of the plurality of equilateral triangle faces. Multiple folding further imparts structural rigidity onto the resulting design, by for example, introducing multiple layers of material to increase thickness. In this regard, one can begin with a variably thin sheet of material, with resulting folds in accordance with the described methods increasing the ultimate wall thickness of the constructed fashion accessory. Importantly, a chief improvement of the described processes and constructions is use of attachment mechanisms to construct the fashion accessory. In particular, addition of an attachment mechanism such as stitching, gluing, pins, snaps, grommets, and any combination at points of contact between adjacent Sonobe units allows for durable structural attachments beyond the mere static friction or modest pinching pressure normally holding units together via the extension points and pockets. In this regard, one may introduce these attachment mechanisms at aesthetically desirable, or mechanically important positions, wherein two or more Sonobe units are co-planar (i.e., overlapping).

Described herein is a method for constructing a fashion accessory, including providing one or more Sonobe units, and assembling the one or more Sonobe units to construct a fashion accessory, wherein assembly of the one or more Sonobe units includes insertion of an extension point from at least one Sonobe unit into the pocket of a Sonobe unit. In another embodiment, insertion of an extension point from at least one Sonobe unit into the pocket of a Sonobe unit includes at least two different Sonobe units adjacent to one another, the extension point and pocket being formed by different Sonobe units. In another embodiment, insertion of an extension point from at least one Sonobe unit into the pocket of a different Sonobe unit is repeated at least two, three, four, five, six, seven, eight, nine, ten, eleven, twelve, thirteen, fourteen, fifteen, sixteen, seventeen, eighteen, nineteen, twenty or more times. In another embodiment, at least two different Sonobe units includes two, three, four, five, six, seven, eight, nine, ten, eleven, twelve, or more Sonobe units. In another embodiment, at least two different Sonobe units are assembled to form at least two identical sub-assemblies, and the at least two identical sub-assemblies are further assembled to construct the fashion accessory. In another embodiment, folding of one or more substantially square materials into a Sonobe unit to provide the one or more Sonobe units. In another embodiment, the one or more Sonobe units are each made of a flexible material capable of maintaining a fold, selected from the group consisting of leather, fabric, plastic, sheet metal, paper and cardboard. In another embodiment, the at least two different Sonobe units comprise one or more Sonobe units of a particular color. In another embodiment, the at least two different Sonobe units comprise one or more Sonobe units of a particular material. In another embodiment, the at least two different Sonobe units comprise one or more Sonobe units of a particular pattern. In another embodiment, the method further including: configuring the fashion accessory to possess one or more colors, one or more materials, one or more patterns, at one or more predetermined locations on the fashion accessory. In another embodiment, the method further including: fixing one or more means for attachment to the fashion accessory. In another embodiment, the means for attachment includes stitching, gluing, pins, snaps, and/or grommets. In another embodiment, fixing one or more means for attachment includes fixing at a position wherein one or more Sonobe units are co-planar. In another embodiment, the method further includes attaching one or more ornamental features to the fashion accessory. In another embodiment, one or more ornamental features includes straps, handles, belts, hooks, or wheels onto the fashion accessory.

Further described herein is method for constructing a fashion accessory, including: generating one customized Sonobe unit having a shape of a parallelogram; and affixing at least two foldable portions of the one customized Sonobe unit to construct a fashion accessory. In another embodiment, the one customized Sonobe unit is made of a flexible material selected from the group consisting of leather, fabric, plastic, sheet metal, paper, cardboard and any combination thereof. In another embodiment, the method further includes configuring the fashion accessory to display a specifically targeted region of art designs on the flexible material at one or more predetermined locations on the fashion accessory. In another embodiment, the method further includes selecting a flexible material configurable and capable of being affixed and attached by attachment mechanism to construct the fashion accessory. In another embodiment, the attachment mechanism is stitching, gluing, or another affixing form selected from the group consists of pins, snaps, grommets, and any combination thereof. In another embodiment, the method includes adapting to at least two different shapes of the fashion accessory, wherein the fashion accessory having a plurality of configurable multiple geometric arrangements, by a user. In another embodiment, the method includes attaching one or more straps, handles, belts, hooks, or wheels onto the fashion accessory.

Also described herein is a fashion accessory, produced by a process including: providing one or more Sonobe units; and assembling one or more Sonobe units to construct the fashion accessory, wherein assembly of one or more Sonobe units includes insertion of an extension point from at least one Sonobe unit into the pocket of a Sonobe unit. In another embodiment, insertion of an extension point from at least one Sonobe unit into the pocket of a Sonobe unit includes at least two different Sonobe units adjacent to one another, the extension point and pocket being formed by different Sonobe units. In another embodiment, insertion of an extension point from at least one Sonobe unit into the pocket of a different Sonobe unit is repeated at least two, three, four, five, six, seven, eight, nine, ten, eleven, twelve, thirteen, fourteen, fifteen, sixteen, seventeen, eighteen, nineteen, twenty or more times. In another embodiment, at least two different Sonobe units includes two, three, four, five, six, seven, eight, nine, ten, eleven, twelve, or more Sonobe units. In another embodiment, the process further includes fixing one or more means for attachment at a position wherein one or more Sonobe units are co-planar. In another embodiment, the means for attachment includes stitching, gluing, pins, snaps, and/or grommets. In another embodiment, one or more Sonobe unit is constructed from a flexible material capable of maintaining a fold. In another embodiment, the flexible material is selected from the group consisting of leather, fabric, plastic, sheet metal, paper, and cardboard. In another embodiment, the fashion accessory has at least two colors, one or more materials, or one or more patterns. In another embodiment, the fashion accessory has one or more straps, handles, belts, hooks, wheels, or any combination thereof attached onto the fashion accessory. In another embodiment, the fashion accessory has a plurality of configurable multiple geometric arrangements adapted to at least two different shapes by a user. In another embodiment, the fashion accessary is a wallet, clutch, purse, handbag, briefcase, luggage, backpack, shopping bag, jewelry, make-up kit, holster, or bow tie.

Further described herein is a fashion accessory, produced by a process including: providing one or more Sonobe units; assembling one or more Sonobe units by inserting an extension point from at least one Sonobe unit into the pocket of a different adjacent Sonobe unit, and repeating the insertion among the one or more Sonobe units; and fixing one or more means for attachment at a position wherein one or more Sonobe units are co-planar.

Other aspects of the invention include constructing fashion accessories by attaching one or more straps, handles, belts, hooks, or wheels or other elements readily recognized by those skilled in the art onto the fashion accessory for efficient carrying of articles enclosed by the fashion accessories or wearing the fashion accessories. In some embodiments, fashion accessories constructed by methods set forth herein include one or more pockets, belts, hooks, or other attached features readily appreciated by those skilled in art to stylize the fashion accessories for carrying various articles or wearing the fashion accessories. Other objects, advantages and features of the invention will become more apparent from the following description.

EXAMPLES

The following examples are provided to better illustrate the claimed invention and are not to be interpreted as limiting the scope of the subject matter. To the extent that specific materials are mentioned, it is merely for purposes of illustration and is not intended to limit the invention. One skilled in the art may develop equivalent means, compositions or configurations without the exercise of inventive capacity and without departing from the scope of the present inventions. Schematic diagrams are provided as non-limiting examples to better illustrate the claimed invention of methods of constructing fashion accessories. Figures are provided as non-limiting illustrations of the claimed invention of the fashion accessories constructed by the methods set forth herein. It is appreciated that various unit descriptions here may be practiced by simply relying on a designated color for a particular unit type (e.g., "A", "B", "C") in order to visualize the process, but that such descriptions herein are merely for illustrative purposes to highlight orientation of certain units in an assembly.

Example 1

Figure 1B:
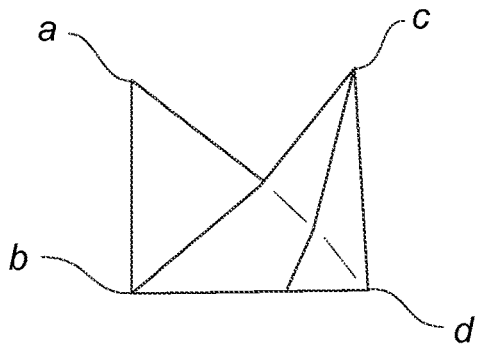
Figure 1C:
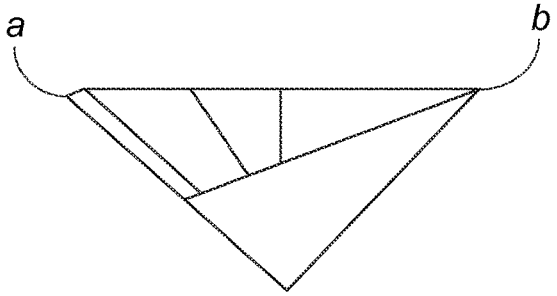
Figure 1D:
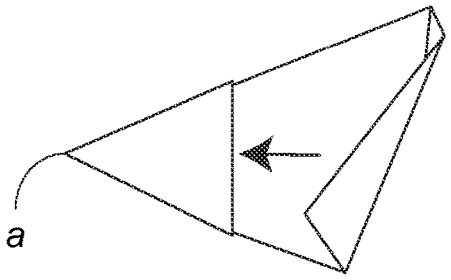
Figure 1E:
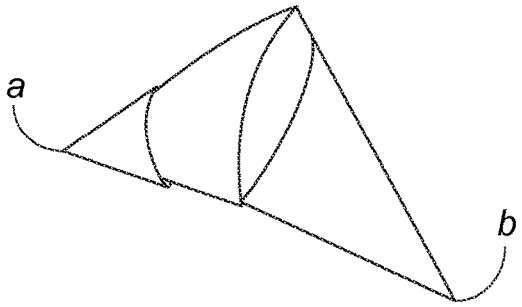

Depicted herein is a workflow process for constructing a fashion accessory such as a holster in accordance with the described invention. An exemplary modular Sonobe unit is shown in FIG. 1A, with subsequent folding demonstrating the construction of a fashion accessory with a compartment for storage, with a reversibly open and closing top portion. As can be seen in FIG. 1A, the modular Sonobe unit is a parallelogram-like shape that contains two extension points and two pockets therein, surrounding by a center square in the middle. Construction in accordance with the described invention takes several steps, including: Step 1 Mountain fold unit from corner "b" to corner "d" (FIGS. 1A, 1B). Step 2 Tuck extension point "a" into pocket at corner "d" (FIG. 1B). Step 3 Take extension point "a" and mountain fold to corner "b" (FIGS. 1C, 1D). Step 4 Once complete, the user may close the fashion accessory by taking corner "b" and folding to "a" (FIG. 1E).

Example 2

Figure 2A:
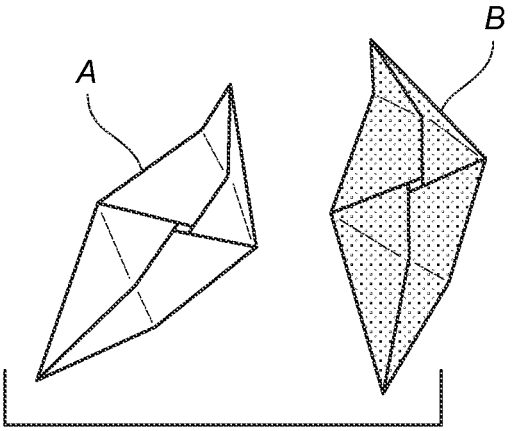
FIGS. 2A-2F depict an exemplary fashion accessory and folding demonstrating the construction of a fashion accessory constructed from multiple Sonobe units.
Figure 2B:
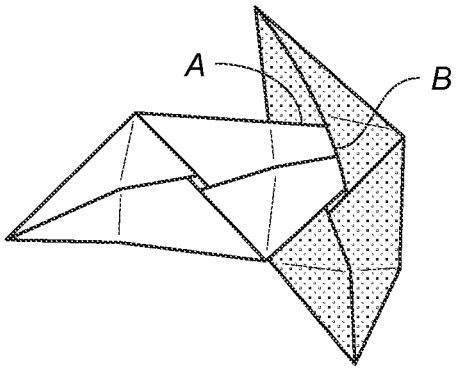
Figure 2C:
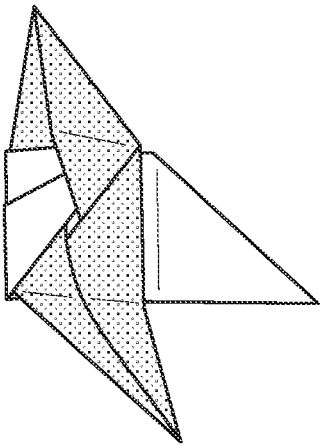
Figure 2D:
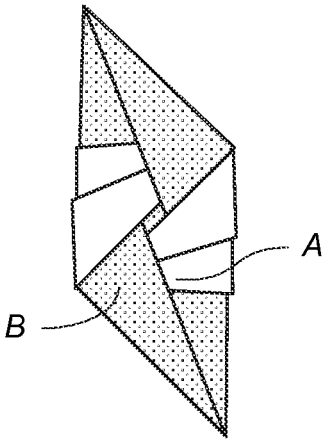
Figure 2E:
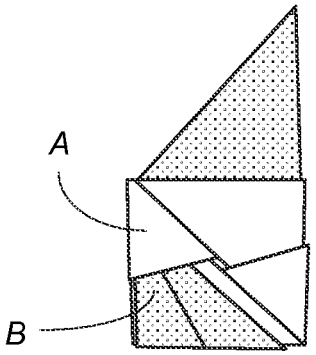
Figure 2F:
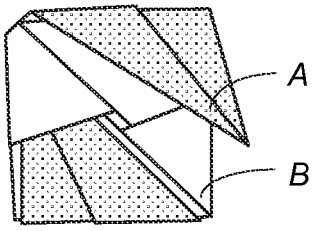

In an additional example, a fashion accessory can be constructed from multiple Sonobe units, including 2 units in the follow process, including: Step 1 Start with 2 units, A and B (FIG. 2A). Step 2 Tuck extension point of unit "A" into a pocket at corner of unit "B" (FIGS. 2A, 2B). Step 3 Fold one Sonobe unit behind the other unit as shown (FIG. 2C). Step 4 Tuck extension point of "A" into pocket of unit "B" (FIG. 2D). Step 5 Flip assembly unit over and tuck extension point of unit "B" into pocket of unit "A" (FIG. 2E). Step 6 Once complete, user may close square by folding extension point of unit "A" to a corner of unit "B" (FIG. 2F).

Example 3

Figure 3A:
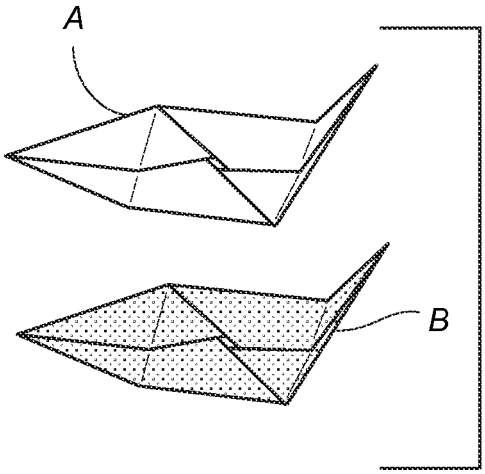
FIGS. 3A-3E depict another exemplary fashion accessory and folding demonstrating the construction of a fashion accessory constructed from two Sonobe units.
Figure 3B:
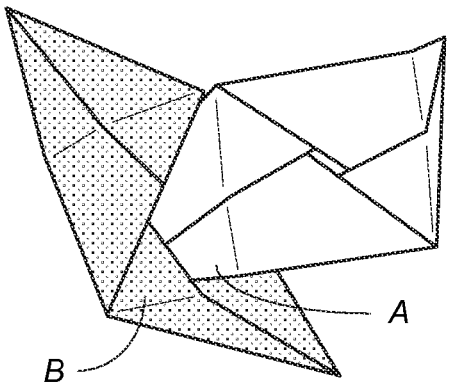
Figure 3C:
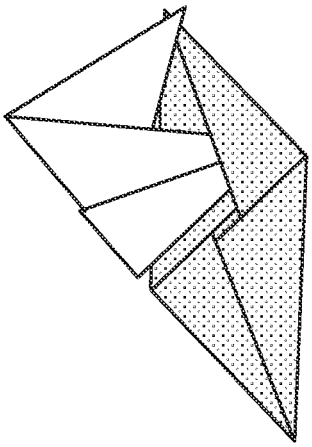
Figure 3D:
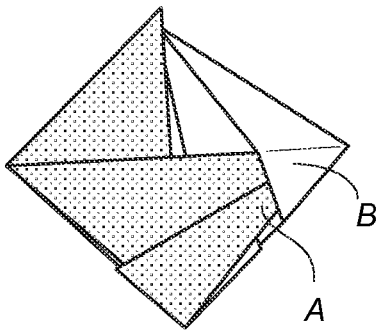
Figure 3E:
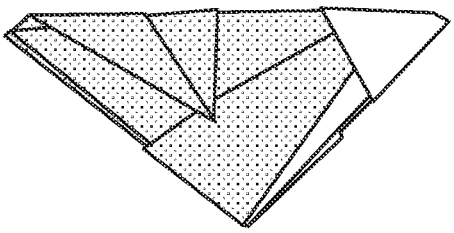

In another example, a fashion accessory can be constructed from multiple Sonobe units, including 2 units in the follow process, including: Step 1 Start with 2 units, A and B (FIG. 3A). Step 2 Tuck an extension point of unit "A" into pocket of unit "B". (FIG. 3B) Step 3 Fold unit "A" along center seam behind itself (FIG. 3C). Step 4 Fold unit "B" along center seam behind itself and tuck unit "B" extension point into pocket of unit "A" (FIG. 3D) Step 5 Once complete user can close the bag by folding the flaps directly down.

Example 4

Figure 4A:
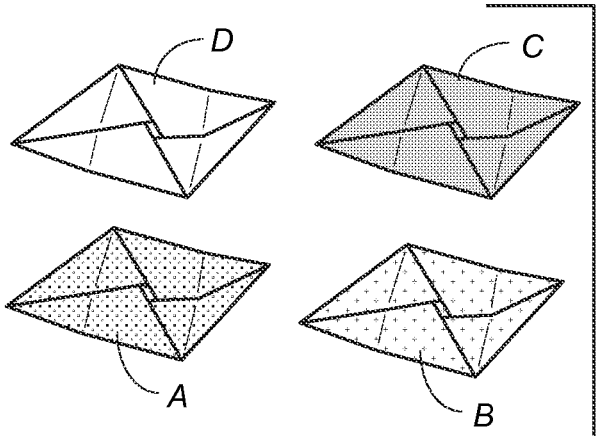
FIGS. 4A-4M depict another exemplary fashion accessory and folding demonstrating the construction of a fashion accessory constructed from four Sonobe units.
Figure 4B:
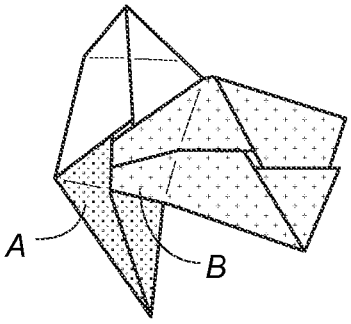
Figure 4C:
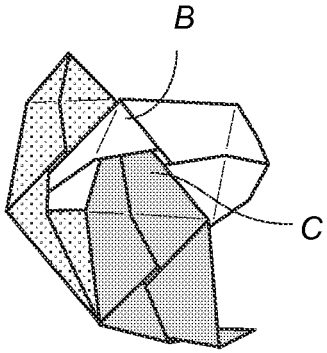
Figure 4D:
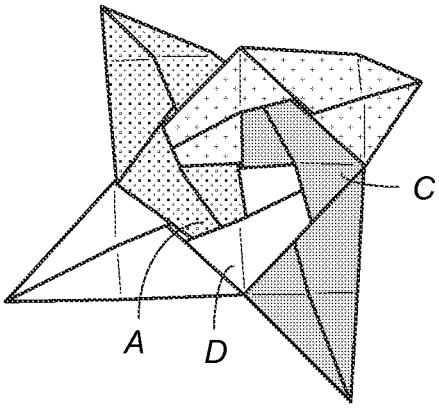
Figure 4E:
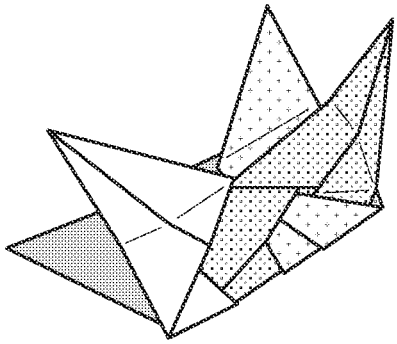
Figure 4F:
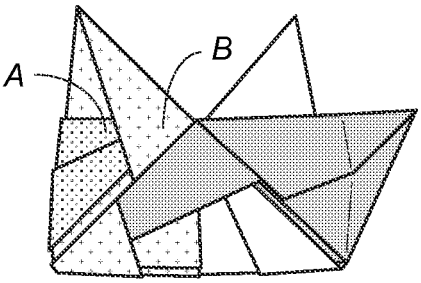
Figure 4G:
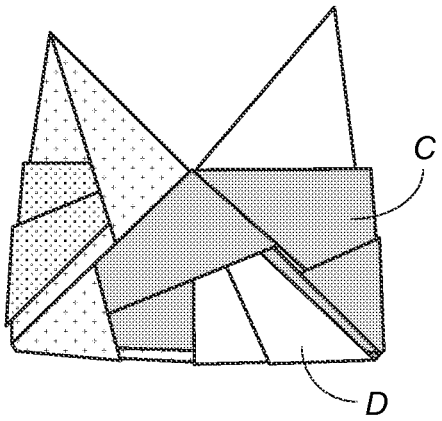
Figure 4H:
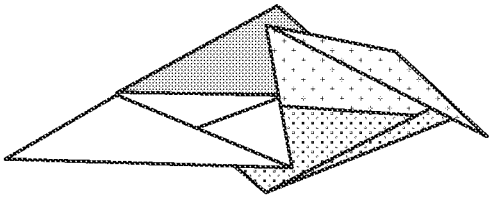
Figure 4I:
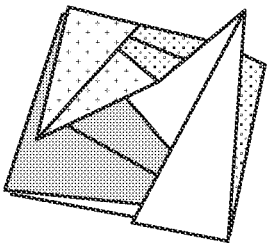
Figure 4J:
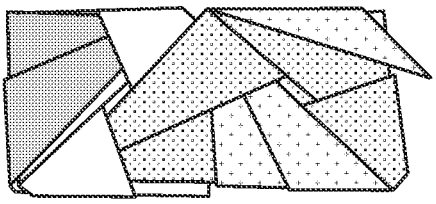

In another example, a fashion accessory can be constructed from multiple Sonobe units, including 4 units in the follow process, including: Step 1 Start with 4 units, A-D (FIG. 4A). Step 2 Tuck extension point of unit "B" into pocket of unit "A". (FIG. 4B) Step 3 Tuck unit "C" extension point into pocket of a unit "B" (FIG. 4C) Step 4 Tuck extension point of unit "D" into pocket of unit "C" (FIG. 4D). Step 5 Tuck extension point of unit "A" into unit "D". (FIG. 4D). Step 6 Fold along centerline of object (FIG. 4E). Step 7 Tuck extension point of unit "A" into pocket of unit "B" (FIG. 4F). Step 8 Tuck extension point of unit "C" into pocket of unit "D". (FIG. 4G) Step 9 Once complete, user may fold down flaps to maintain rectangle or across to create a square (FIGS. 4H, 4I).

Figure 4K:
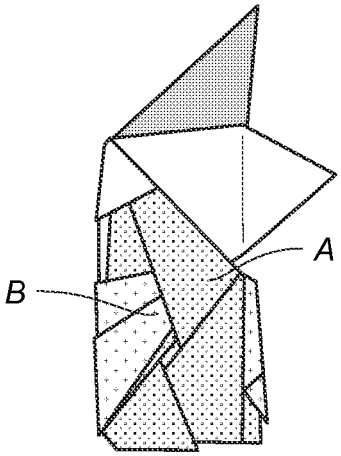
Figure 4L:
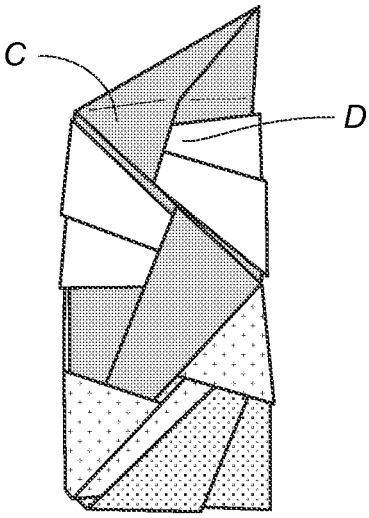
Figure 4M:
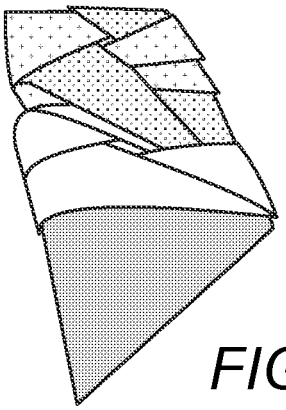

In an alternative embodiment demonstrating the versatility of the design, one can complete Steps 1-6, but instead tuck extension point of unit "B" into pocket of unit "A" (FIG. 4K). Step 12 Tuck extension point of unit "D" into pocket of unit "C" (FIG. 4L). Step 13 To close the bag, fold down green flap (FIG. 4M).

Example 5

Figure 5A:
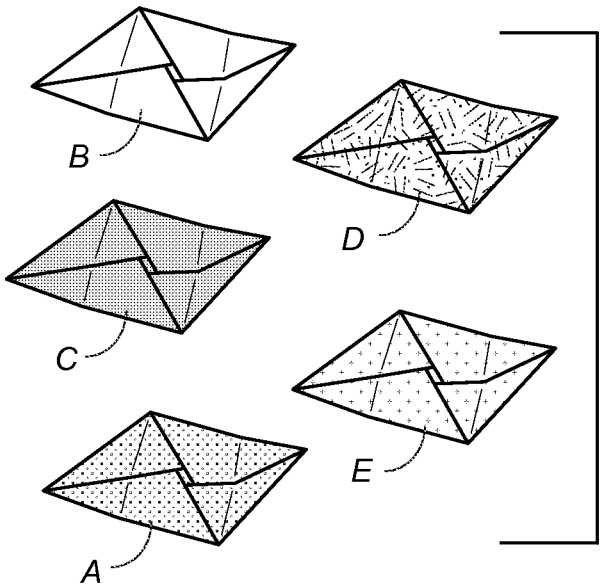
FIGS. 5A-5K depict another exemplary fashion accessory and folding demonstrating the construction of a fashion accessory constructed from five Sonobe units.
Figure 5B:
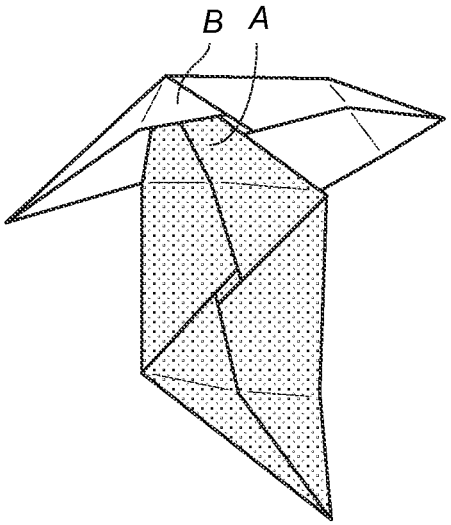
Figure 5C:
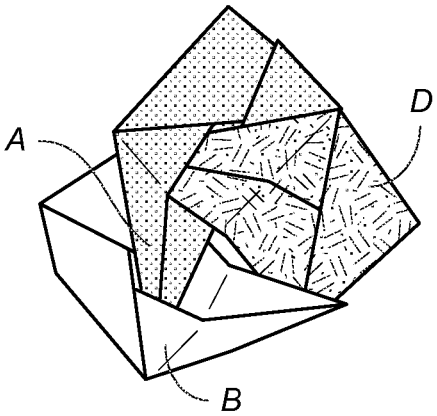
Figure 5D:
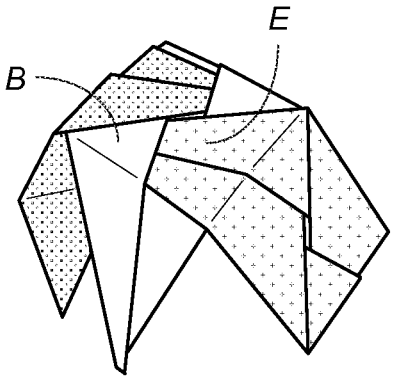
Figure 5E:
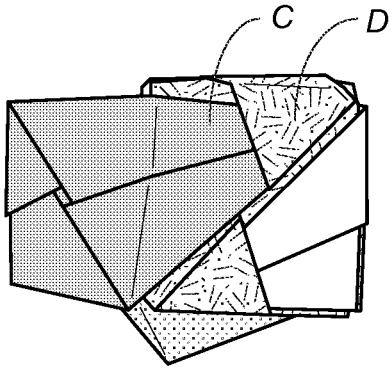
Figure 5F:
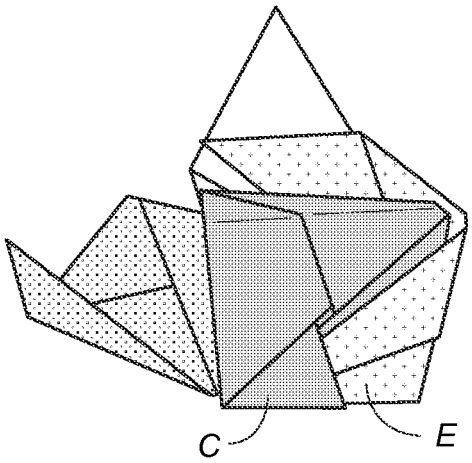
Figure 5G:
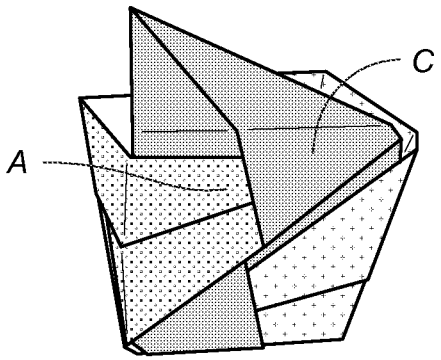
Figure 5H:
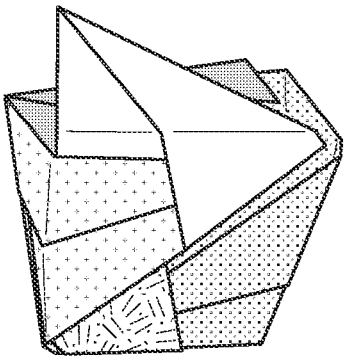
Figure 5I:
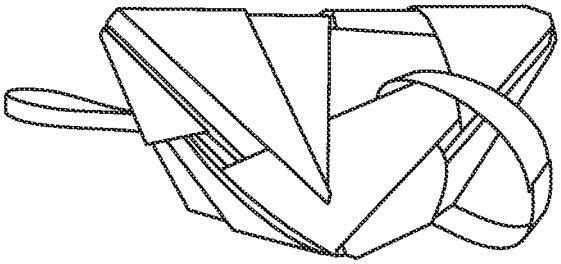
Figure 5J:
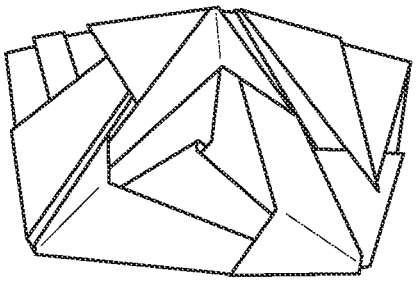
Figure 5K:
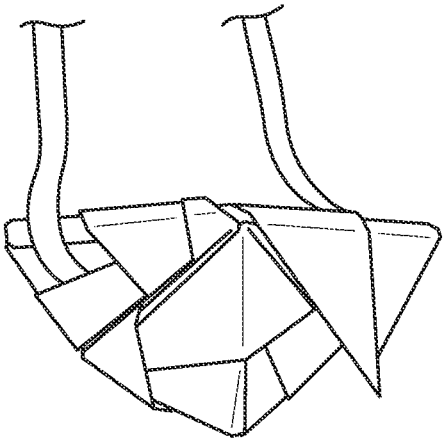

In another example, a fashion accessory can be constructed from multiple Sonobe units, including 5 units in the follow process, including: Step 1 Start with 5 units A-E (FIG. 5A). Step 2 Tuck extension point of unit "A" into pocket of unit "B" (FIG. 5B). Step 3 Tuck extension point of unit "D" into pocket of unit "A". (FIG. 5C). Step 4 Tuck extension point of unit "E" into pocket of unit "B" (FIG. 5D). Step 5 Tuck extension point of unit "C" into pocket of unit "D" (FIG. 5E). Step 6 Tuck extension point of unit "E" into pocket of unit "C" (FIG. 5F). Step 7 Tuck extension point of unit "A" into pocket of unit "C" (FIGS. 5F, 5G). Once complete, user may fold down flaps to form a clutch or across to present an article with a resemblance with a cat animal (FIG. 5H-5K).

Example 6

Figure 6A:
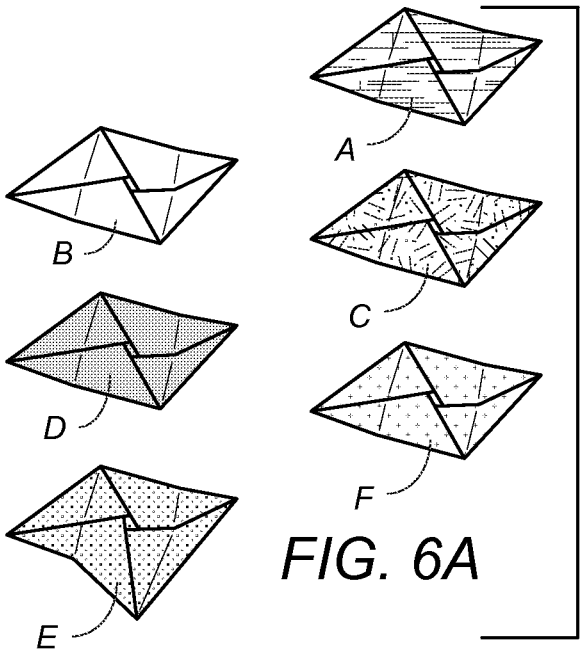
FIGS. 6A-6P depict another exemplary fashion accessory and folding demonstrating the construction of a fashion accessory constructed from six Sonobe units.
Figure 6B:
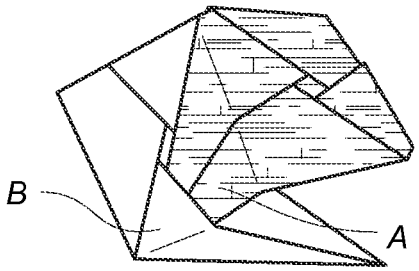
Figure 6C:
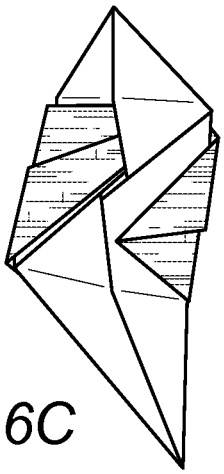
Figure 6D:
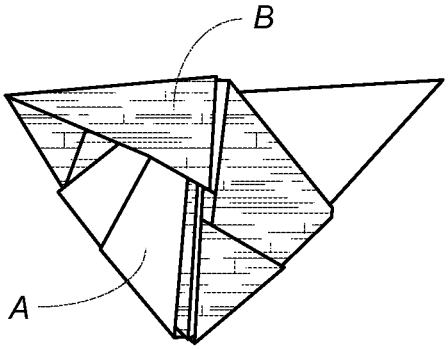
Figure 6E:
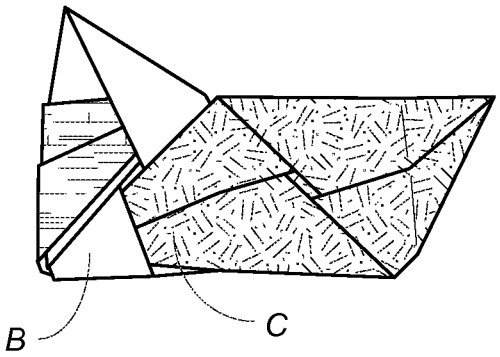
Figure 6F:
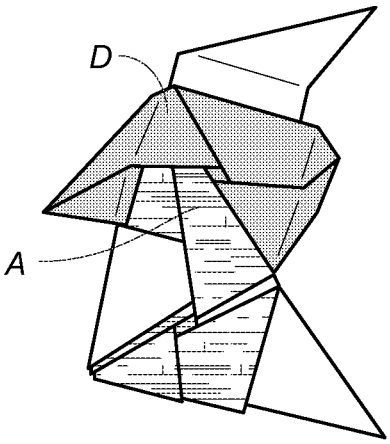
Figure 6G:
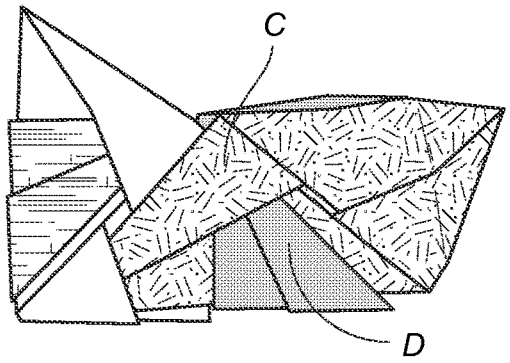
Figure 6H:
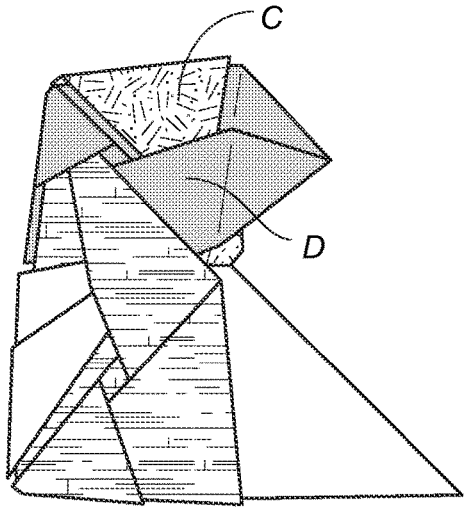
Figure 6I:
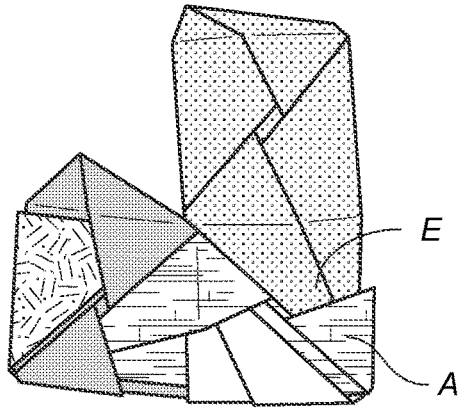
Figure 6J:
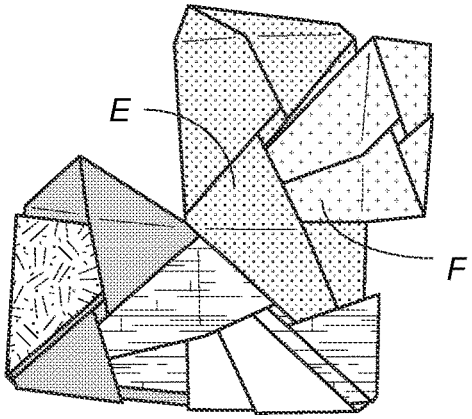
Figure 6K:
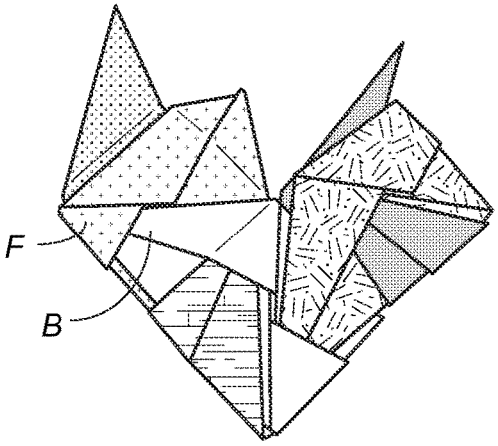
Figure 6L:
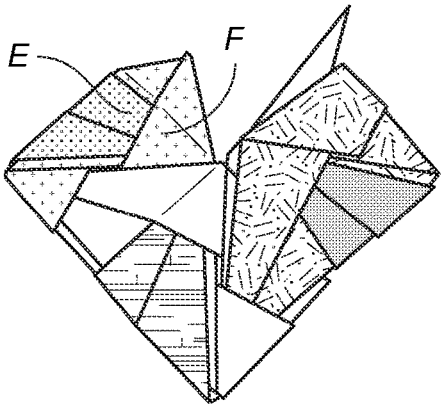
Figure 6M:
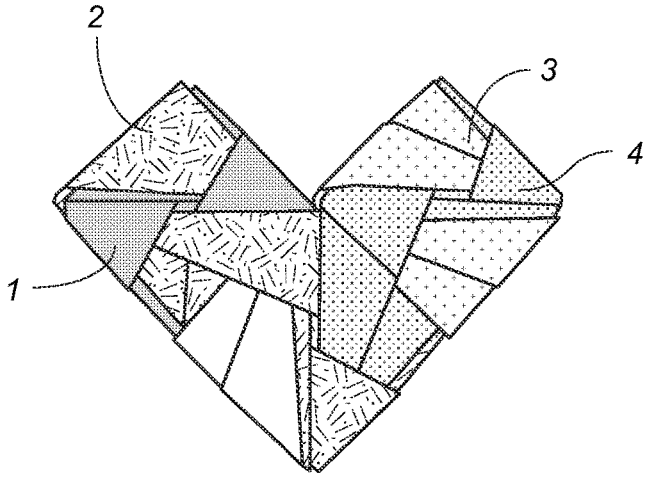
Figure 6N:
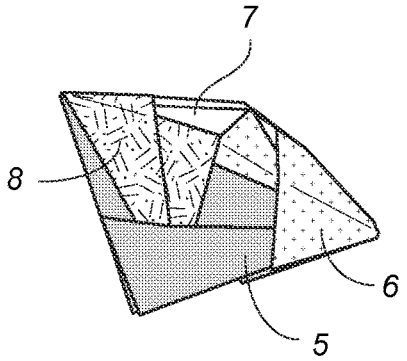
Figure 6O:
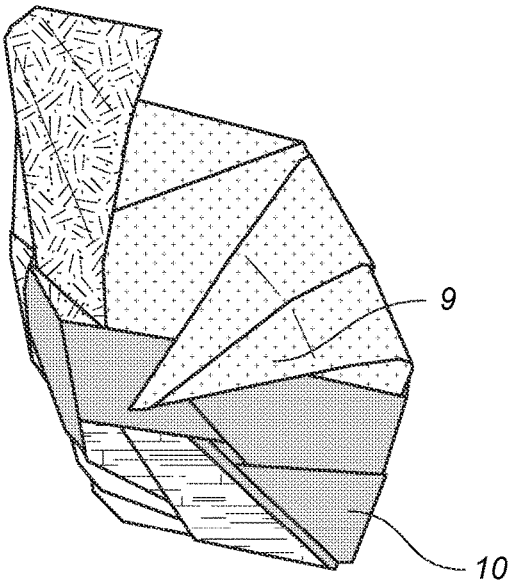
Figure 6P:
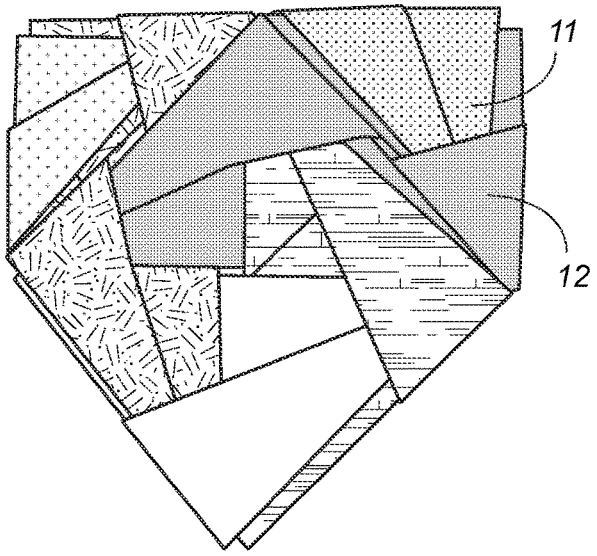

In another example, a fashion accessory can be constructed from multiple Sonobe units, including 6 units in the follow process, including: Step 1 Start with 6 units, A-F (FIG. 6A). Step 2 Tuck extension point of unit "A" into pocket of unit "B" (FIG. 6B). Step 3 Fold one unit beneath the other (FIG. 6C). Step 4 Turn units over and tuck extension point of unit "B" into pocket of unit "A" (FIG. 6D). Step 5 Tuck extension point of unit "C" into pocket of unit "B" (FIG. 6E). Step 6 Tuck extension point of unit "A" into pocket of unit "D" (FIG. 6F). Step 7 Tuck extension point of unit "D" into pocket of unit "C" (FIG. 6G). Step 8 Tuck extension point of unit "C" into pocket of unit "D" (FIG. 6H). Step 9 Tuck extension point of unit "E" into pocket of unit "A" (FIG. 6I). Step 10 Tuck extension point of unit "F" into pocket of unit "E" (FIG. 6J). Step 11 Tuck extension point of unit "B" into pocket of unit "F" (FIG. 6K). Step 12 Tuck extension point of unit "E" into pocket of unit "F" (FIG. 6L). Once complete the user may close the heart-jewel like formation by folding position 1 to position 2, and position 3 to position 4 for a heart-like formation. (FIG. 6M) or alternatively, by folding positions 5 to position 6, and position 7 to position 8 a jewel-like variation (FIG. 6N), or in another form, by folding positions 9 and 10 or positions 11 and 12 for a diamond-like variation (FIG. 6P).

Example 7

Figure 7A:
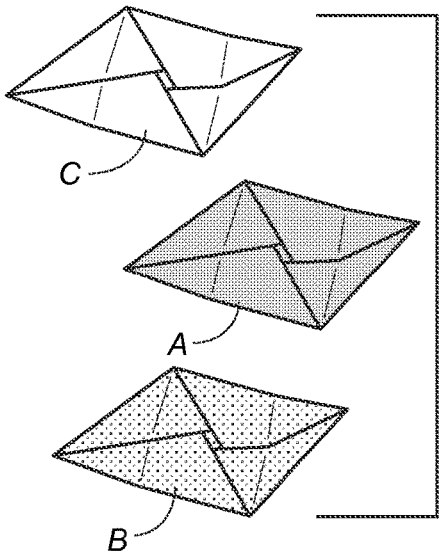
FIGS. 7A-7L depict another exemplary fashion accessory and folding demonstrating the construction of a fashion accessory constructed from six Sonobe units.
Figure 7B:
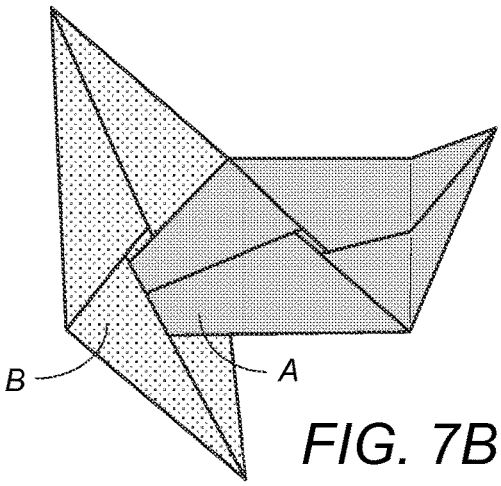
Figure 7C:
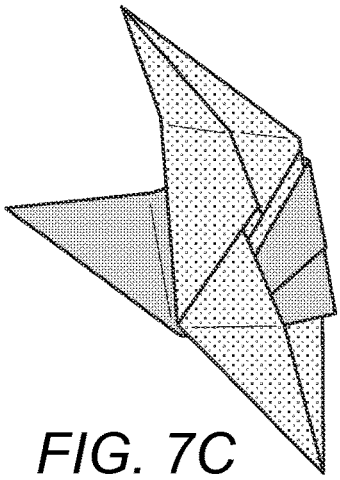
Figure 7D:
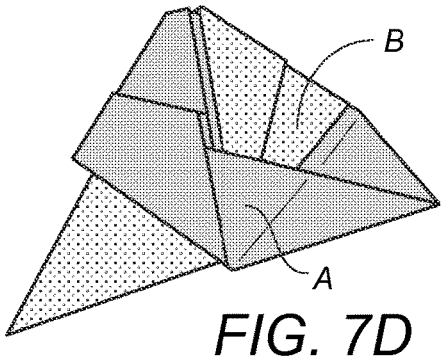
Figure 7E:
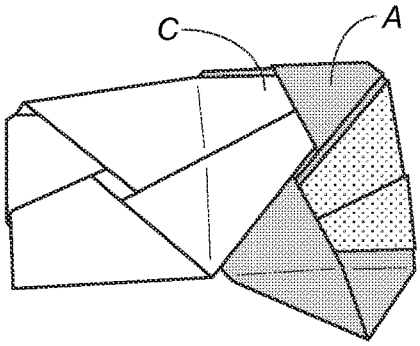
Figure 7F:
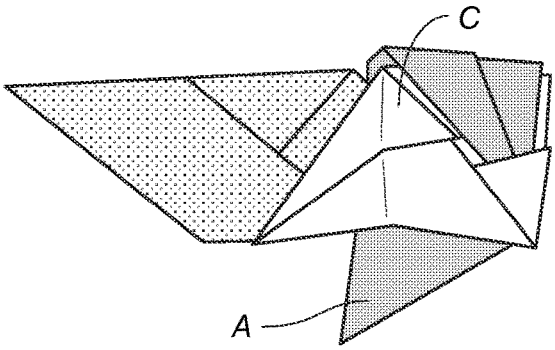
Figure 7G:
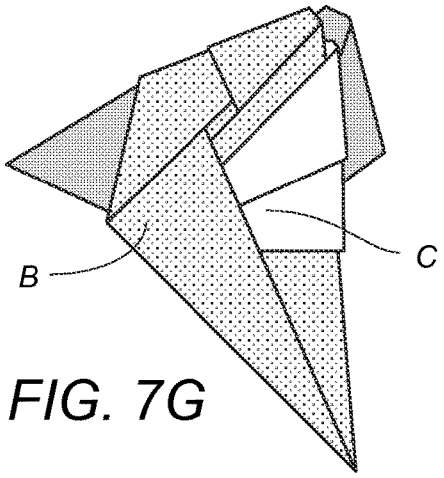
Figure 7H:
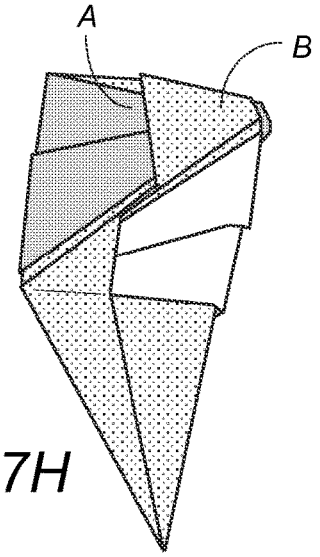
Figure 7I:
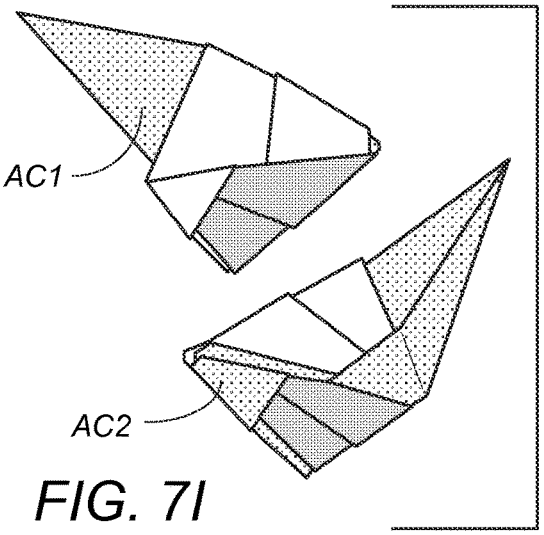
Figure 7J:
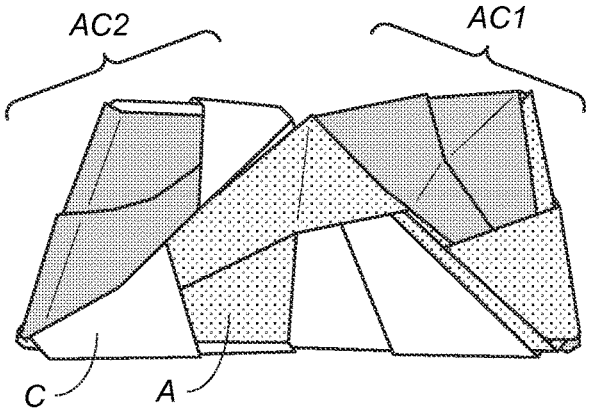
Figure 7K:
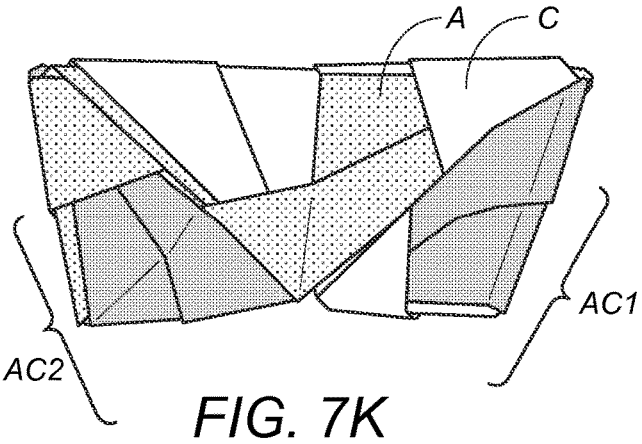
Figure 7L:
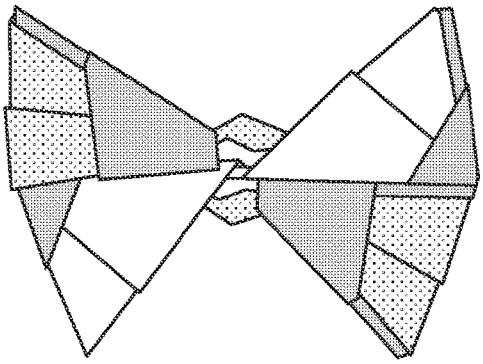

In another example, a fashion accessory can be constructed from multiple Sonobe units, including 6 units in the follow process, which incorporate 2 modular sub-assemblies of 3 units each, including: Step 1 Begin with 6 units, including 2 sets of units A-C (FIG. 7A). Step 2 Tuck extension point of unit "A" into pocket of unit "B" (FIG. 7B). Step 3 Fold unit "A" behind unit "B" (FIG. 7C). Step 4 Tuck extension point of unit "B" into pocket of unit "A" (FIG. 7D). Step 5 Tuck extension point of unit "C" into pocket of unit "A" (FIG. 7E). Step 6 Tuck extension point of unit "A" into pocket of unit "C" (FIG. 7F). Step 7 Tuck extension point of unit "C" into pocket of unit "B" (FIG. 7G). Step 8 Tuck extension point of unit "A" into pocket of unit "B" (FIG. 7H). Step 9 Repeat Steps 2-8 to create an identical set of units composed of A-C, the units being denoted as AC1 and AC2 (FIG. 7I). Step 10 Tuck extension point of unit "A" in AC1 into pocket of unit "C" in AC2 (FIG. 7J). Step 11 Turn set of units over and repeat by tucking extension point of unit "A" in AC2 into pocket unit "C" in AC2 (FIG. 7K). Resulting construction is shown (FIG. 7L).

Example 8

Figure 8A:
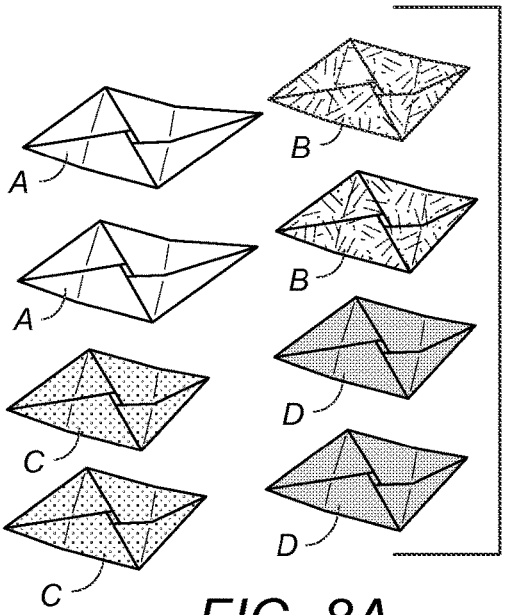
FIGS. 8A-8L depict another exemplary fashion accessory and folding demonstrating the construction of a fashion accessory constructed from eight Sonobe units.
Figure 8B:
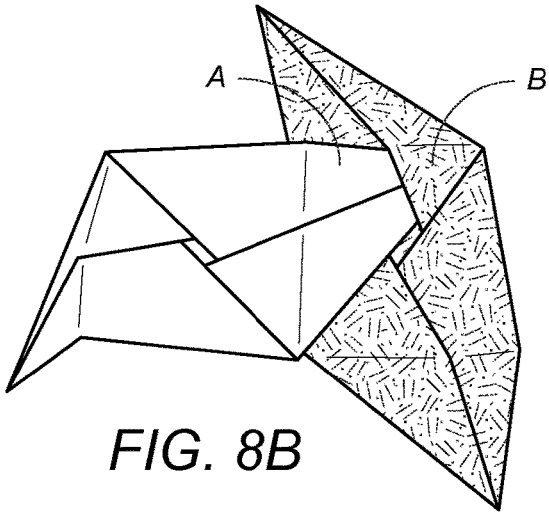
Figure 8C:
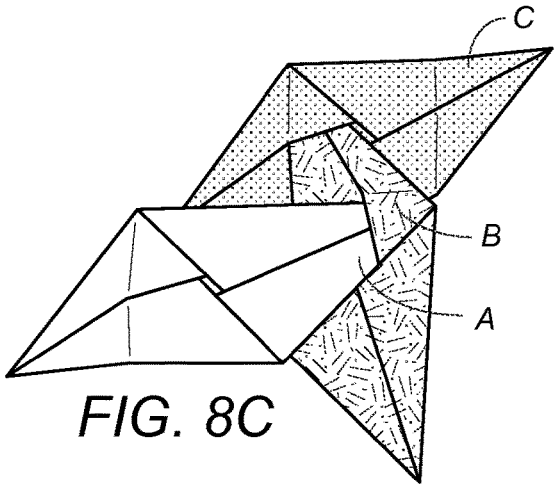
Figure 8D:
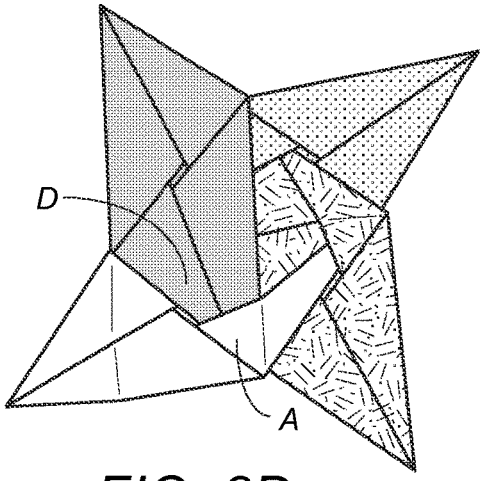
Figure 8E:
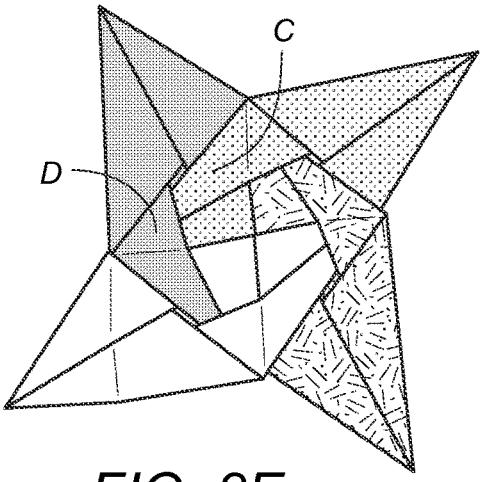
Figure 8F:
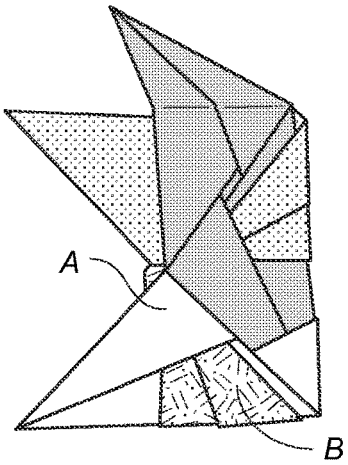
Figure 8G:
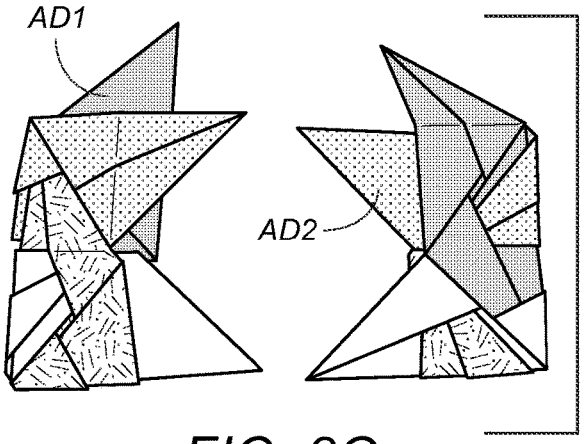
Figure 8H:
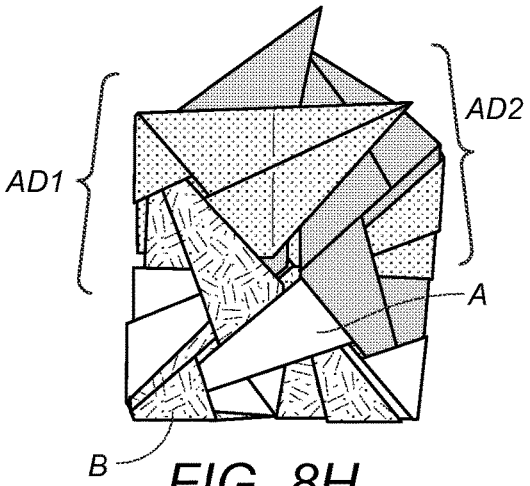
Figure 8I:
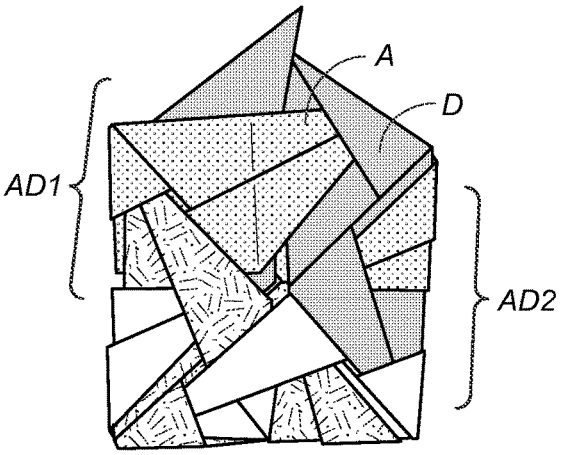
Figure 8J:
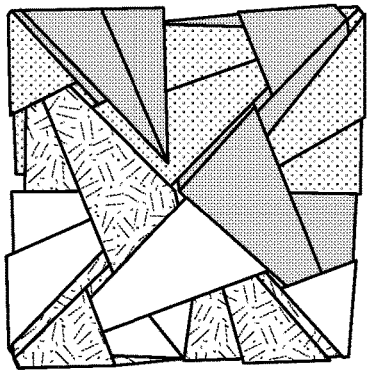
Figure 8K:
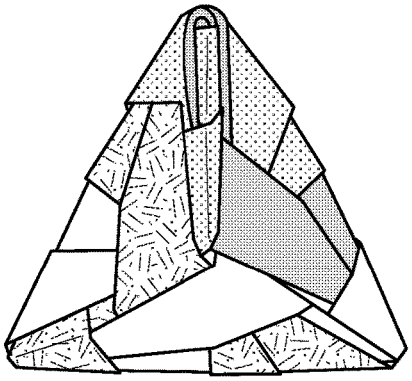
Figure 8L:
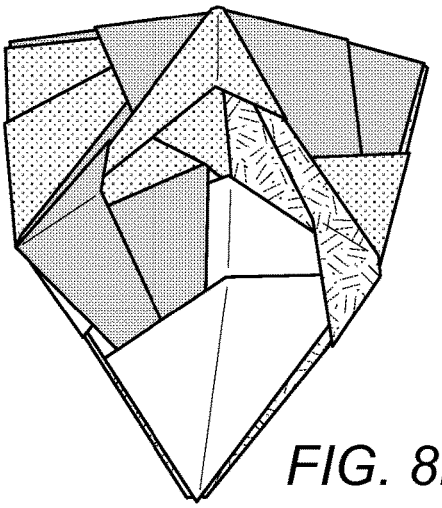

In another example, a fashion accessory can be constructed from multiple Sonobe units, including 8 units in the follow process, which incorporate 2 modular sub-assemblies of 4 units each, including: Step 1 Begin with 8 units, including 2 sets of units A-D. Step 2 Tuck extension point of a unit "A" into pocket of a unit "B" (FIG. 8B). Step 3 Tuck extension point of unit "B" into pocket of a unit "C" (FIG. 8C). Step 4 Tuck extension point of unit "D" into pocket of a unit "A" (FIG. 8D). Step 5 Tuck extension point of unit "C" into pocket of unit "D" (FIG. 8E). Step 6 Tuck extension point of unit "B" into pocket of unit "A" (FIG. 8F). Step 7 Repeat steps 1-6 to create an identical set of units composed of A-D, the units being denoted as AD1 and AD2 (FIG. 8G). Step 8 Tuck extension point of unit "A" of AD2 into pocket of unit "B" of AD1 (FIG. 8H). Step 9 Tuck extension point of unit "B" of AD1 into pocket of unit "D" in AD2 (FIG. 8I). Step 10 Turn over partially constructed assembly and repeat Step 8 and Step 9 on the opposite side. (FIG. 8H, FIG. 8I). Step 11 Once complete the user may close the make-up kit by folding the extension points of unit D to create a square formation or across to create the two-face formation (FIG. 8J-8L).

Example 9

Figure 9A:
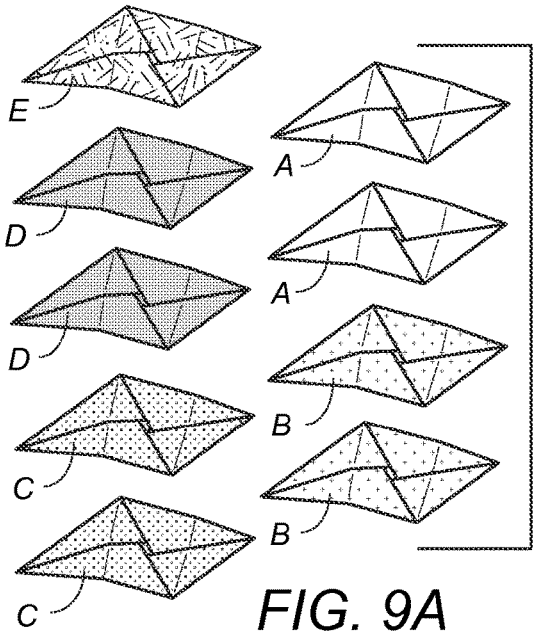
FIGS. 9A-9P depict another exemplary fashion accessory and folding demonstrating the construction of a fashion accessory constructed from nine Sonobe units.
Figure 9B:
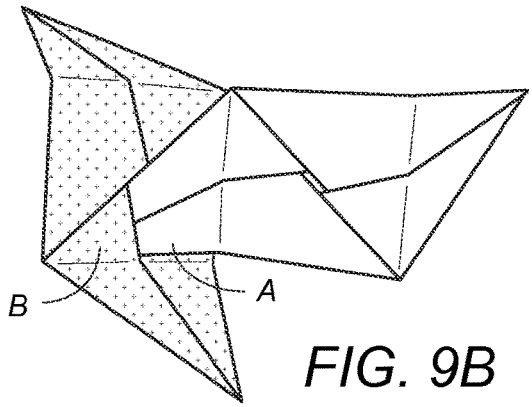
Figure 9C:
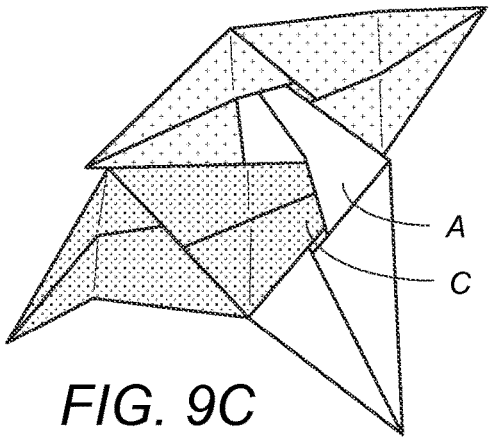
Figure 9D:
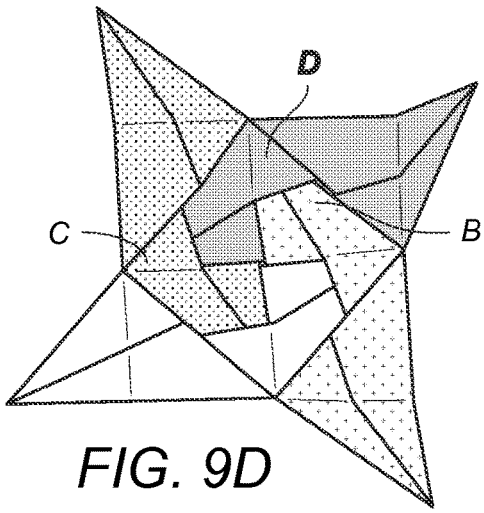
Figure 9E:
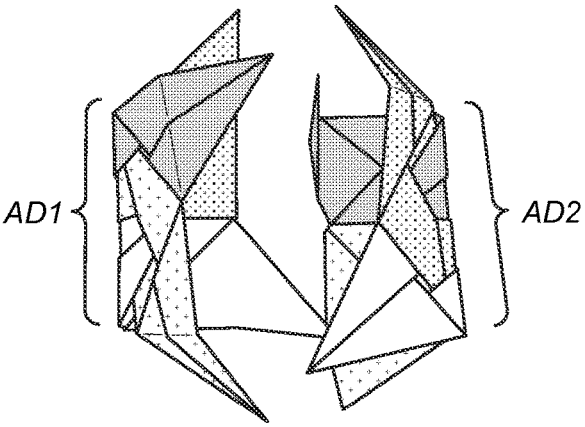
Figure 9F:
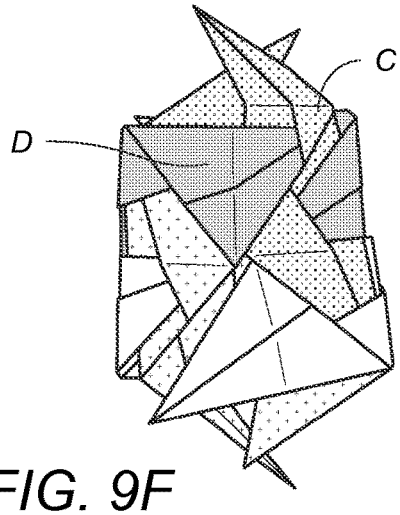
Figure 9G:
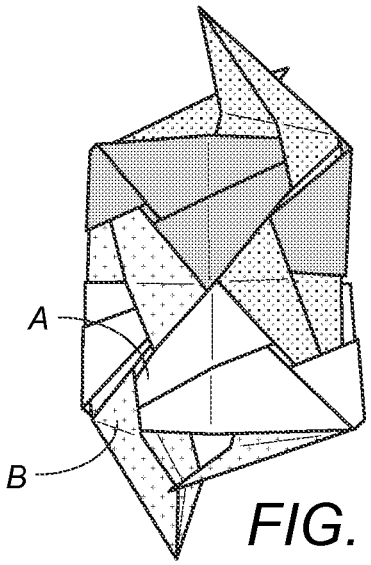
Figure 9H:
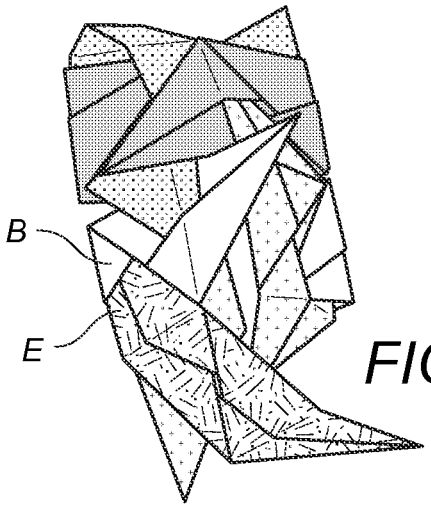
Figure 9I:
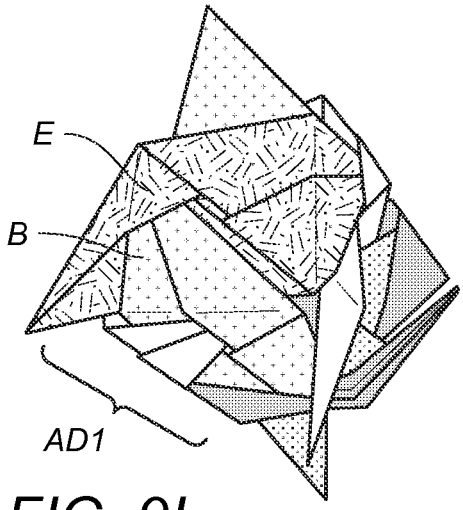
Figure 9J:
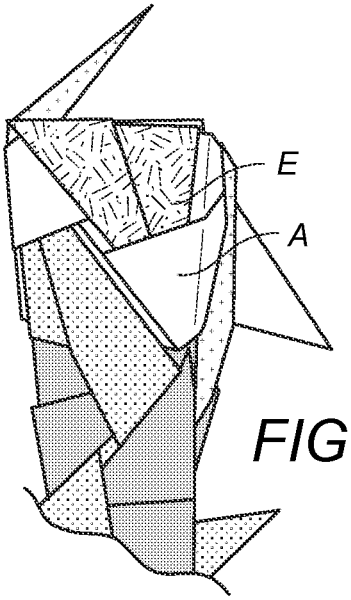
Figure 9K:
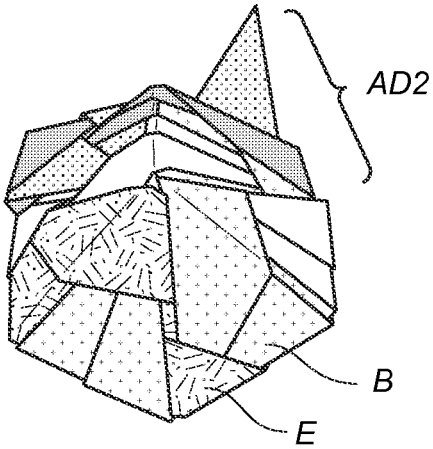
Figure 9L:
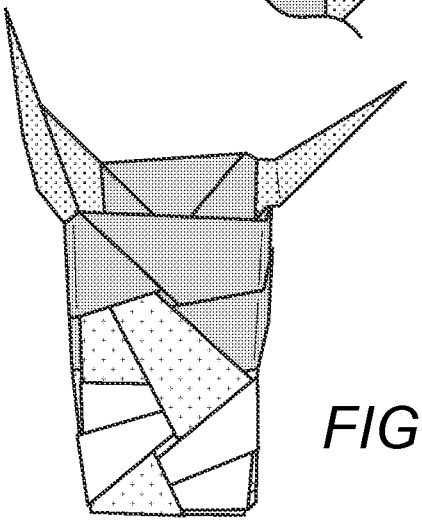

In another example, a fashion accessory can be constructed from multiple Sonobe units, including 9 units in the follow process, which incorporate 2 modular sub-assemblies of 4 units each and an additional 1 unit, including: Step 1 Begin with 9 units (FIG. 9A). Step 2 Tuck extension point of unit "A" into pocket of unit "B" (FIG. 9B). Step 3 Tuck extension point of unit "C" into pocket of unit "A" (FIG. 9C). Step 4 Tuck extension point of unit "D" into pocket of unit "C", and extension point of unit "B" into pocket of unit "D" (FIG. 9D). Step 5 Repeat Steps 2-4 to create an identical set of units composed of A-D, the units being denoted as AD1 and AD2 (FIG. 9E). Step 6 Tuck extension point of unit "D" of AD1 into pocket of unit "C" of AD2 (FIG. 9F). Step 7 Tuck extension point of unit "A" of AD2 to pocket of unit "B" of AD1 (FIG. 9G). Step 8 Tuck extension point of unit "B" of AD1 into pocket of unit "E" (FIG. 9H). Step 9 Tuck extension point of unit "B" of AD1 into pocket of unit "E" (FIG. 9I). Step 10 Tuck extension point of unit "E" into pocket of unit "A" in AD2 (FIG. 9J). Step 11 Tuck extension point of unit "B" of AD2 into pocket of unit "E" (FIG. 9K). For final construction, Steps 6 and 7 on the opposite side are repeated to produce the resulting construction for a fashion accessory (FIG. 9L).

Figure 9M:
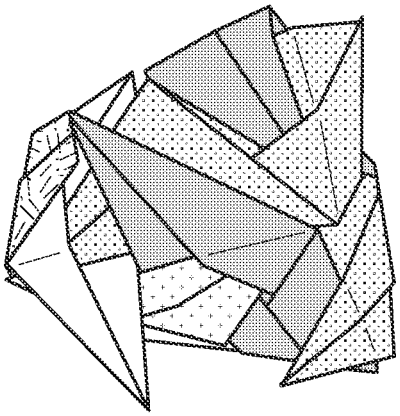
Figure 9N:
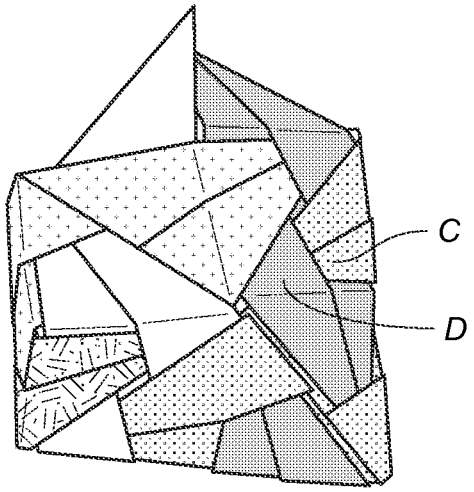
Figure 9O:
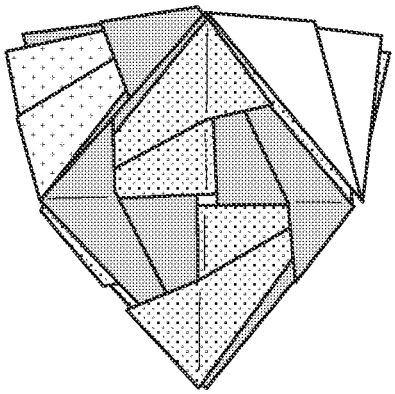
Figure 9P:
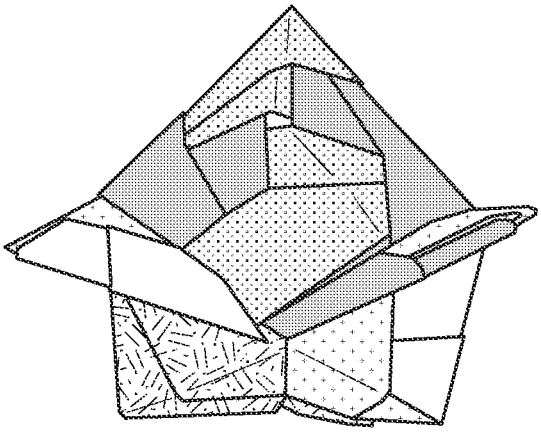

In an alternative embodiment demonstrating the versatility of the design, one can instead skip the final construction step of the above design. Step 12 Instead, tuck extension point of unit "C" into pocket of unit "D" and repeat on opposite side, leaving extension points of only units "C" and "D" remaining (FIGS. 9M and 9N). Step 13 Once complete the user may close the construction by bringing the extension point of the unit "A" to extension point of the unit "D", extension point of unit "C" to unit "D" (FIGS. 9O, 9P).

Example 10

Figure 10A:
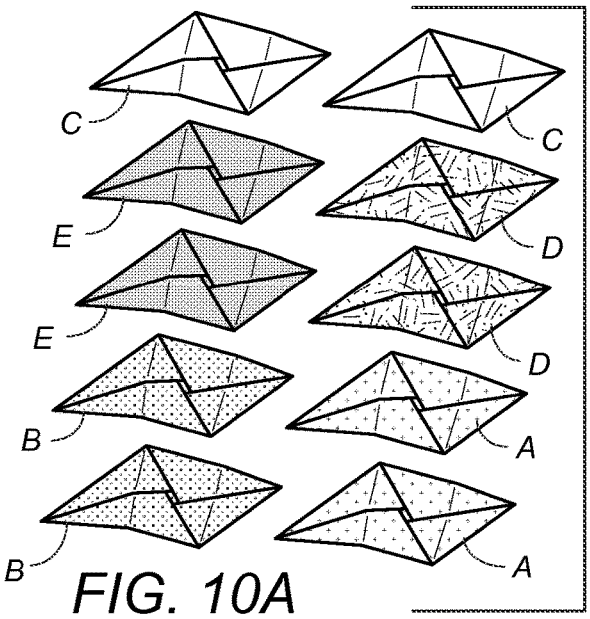
FIGS. 10A-10P depict another exemplary fashion accessory and folding demonstrating the construction of a fashion accessory constructed from ten Sonobe units.
Figure 10B:
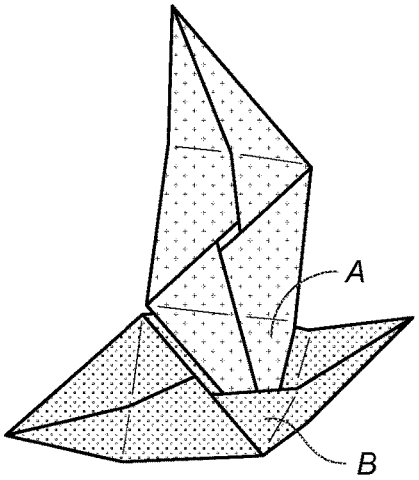
Figure 10C:
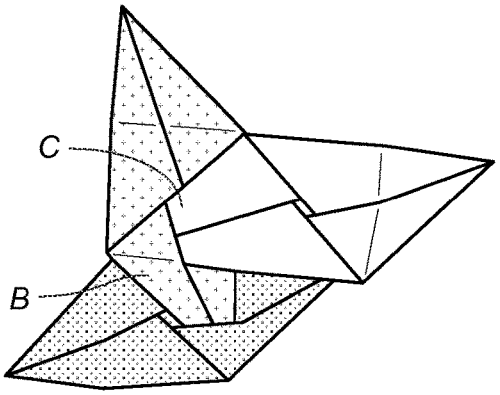
Figure 10D:
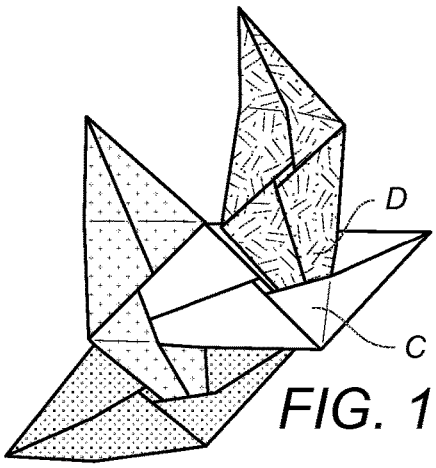
Figure 10E:
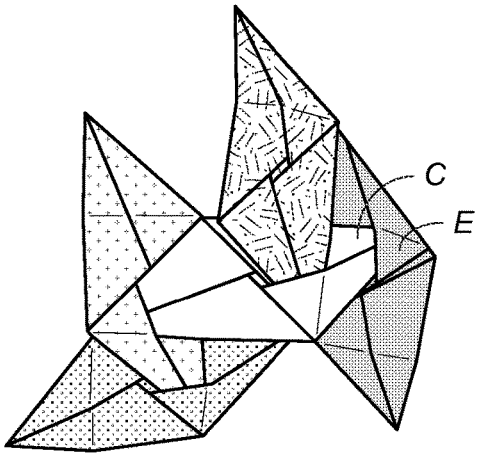
Figure 10F:
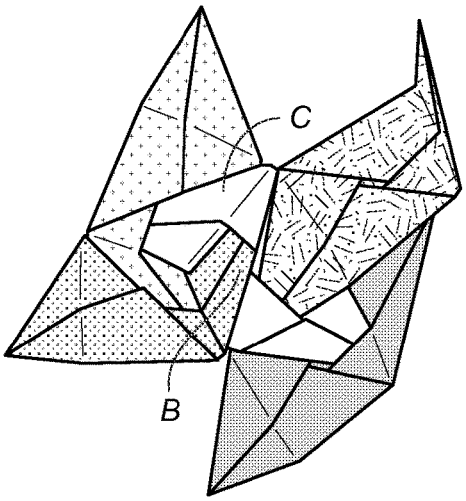
Figure 10G:
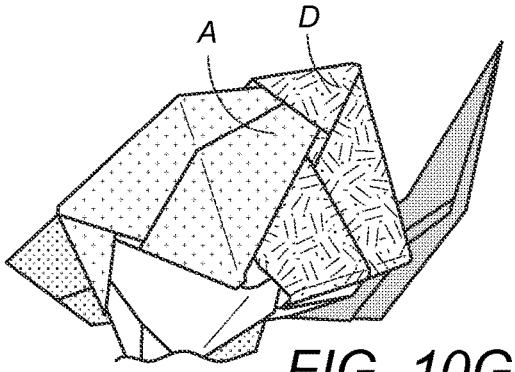
Figure 10H:
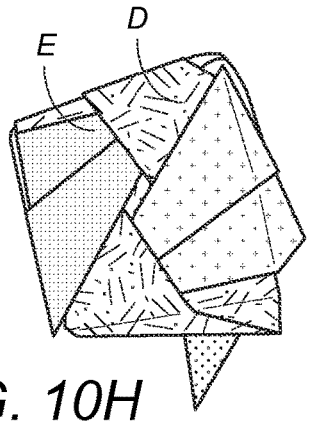
Figure 10I:
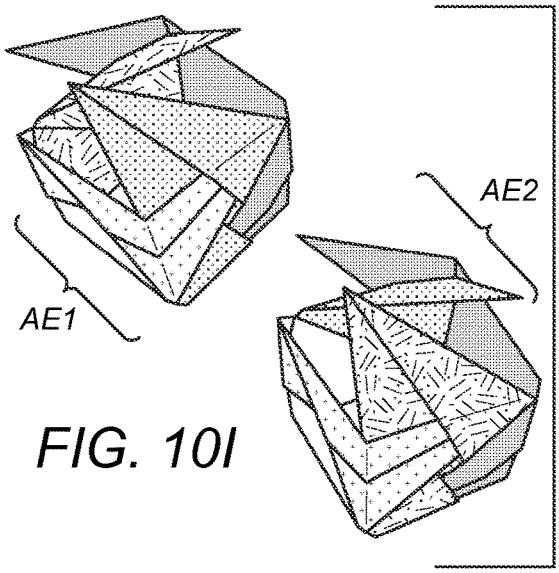
Figure 10J:
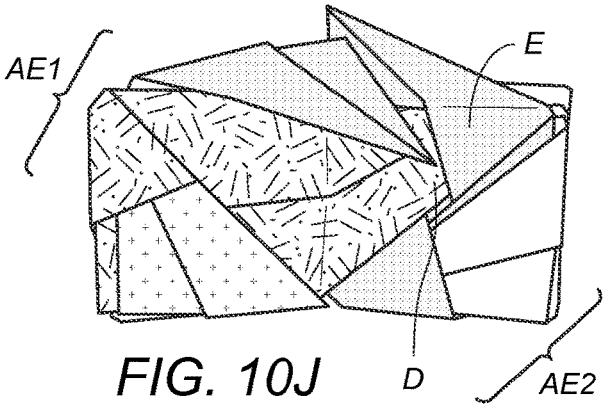
Figure 10K:
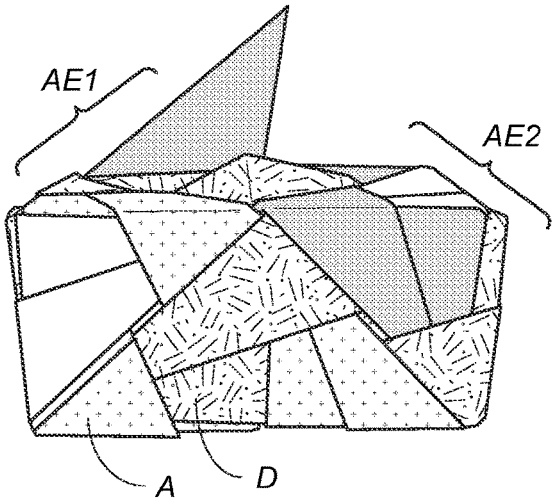
Figure 10L:
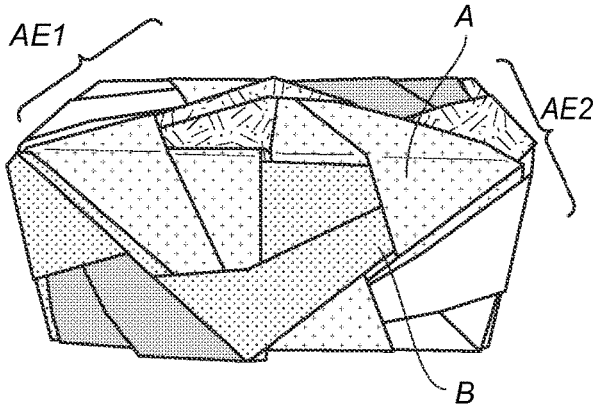
Figure 10M:
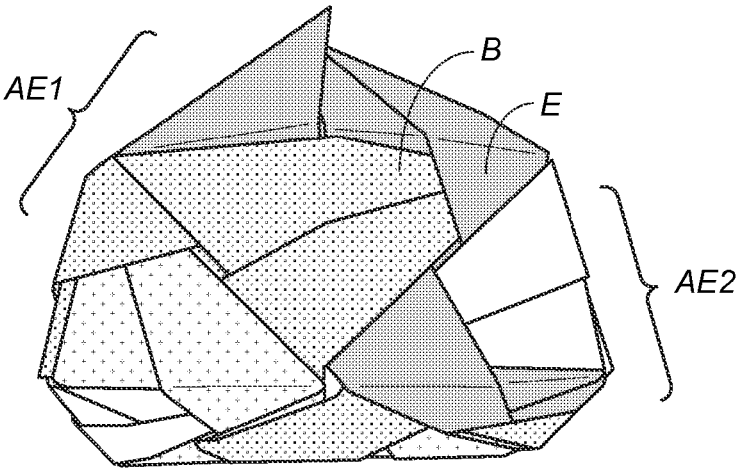
Figure 10N:
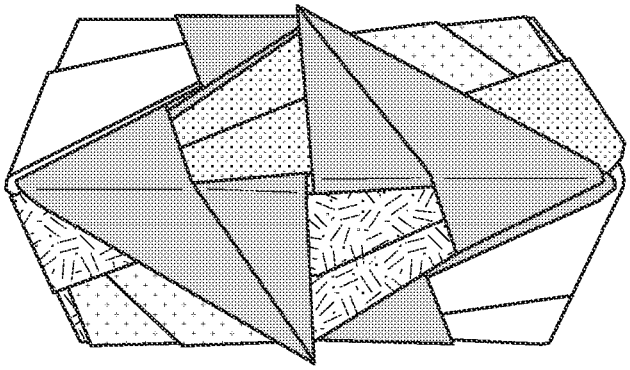
Figure 10O:
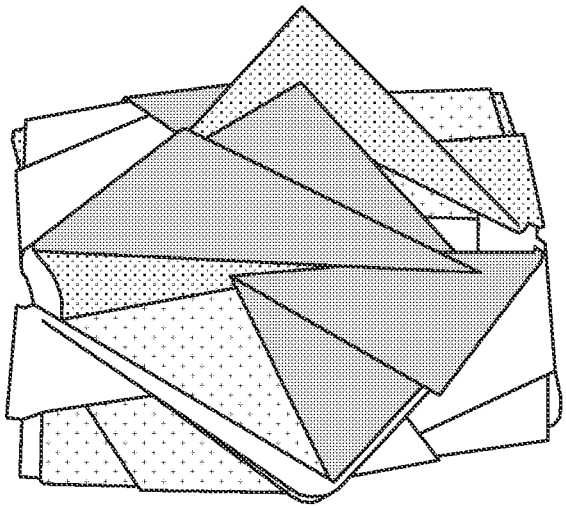
Figure 10P:
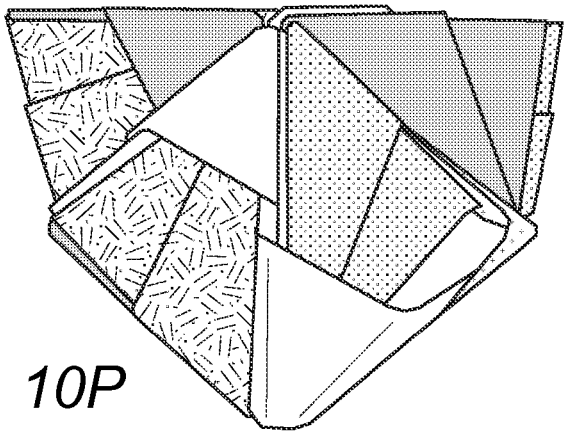

In another example, a fashion accessory can be constructed from multiple Sonobe units, including 10 units in the follow process, which incorporate 2 modular sub-assemblies of 5 units each, including: Step 1 Start with 10 units (FIG. 10A). Step 2 Tuck extension point of unit "A" into pocket of unit "B" (FIG. 10B). Step 3 Tuck extension point of unit "C" into pocket of unit "A" (FIG. 10C). Step 4 Tuck extension point of a unit "D" into pocket of a unit "C" (FIG. 10D). Step 5 Tuck extension point of a unit "C" into pocket of a unit "E" (FIG. 10E). Step 6 Tuck extension point of a unit "B" into pocket of unit "C" (FIG. 10F). Step 7 Tuck extension point of a unit "A" into a pocket of a unit "A" into pocket of a unit "D (FIG. 10G). Step 8 Tuck extension point of a unit "E" into the pocket of a unit "D" (FIG. 10H). Step 9 Repeat Steps 2-8 to create an identical set of units composed of units A-E, the units being denoted as AE1 and AE2 (FIG. 10I). Step 10 Tuck extension point of a unit "D" of AE1 into the pocket of a unit "E" of AE2 (FIG. 10J). Step 11 Turn over and tuck the extension point of unit "D" of AE2 into the pocket of unit "A" of AE1 (FIG. 10K). Step 12*a* Tuck extension point of unit "B" of AE1 into the pocket of unit "A" of AE2 (FIG. 10L). Step 12*b* Tuck extension point of unit "B" of AE1 into pocket of unit "E" of AE2 (FIG. 10M). Step 13 Once complete, the user may close the construction by folding the extension points of "E" directly down into the stiff bag formation or by folding the green flaps across into the scrunchy formation (FIG. 10M-10P).

Example 11

Figure 11A:
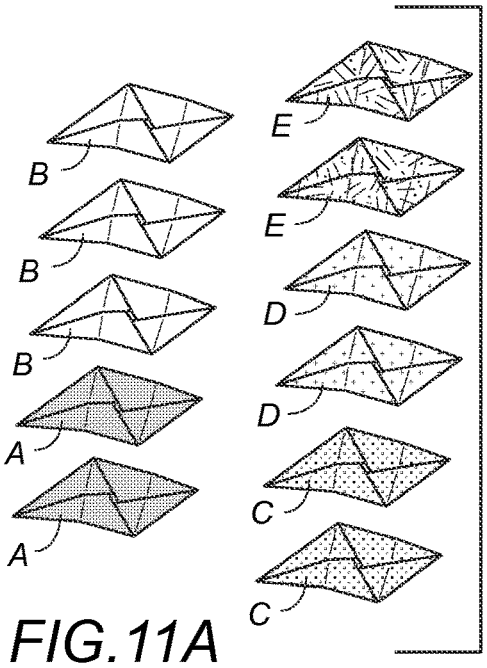
FIGS. 11A-11R depict another exemplary fashion accessory and folding demosntrating the construction of a fashion accessory constructed from eleven Sonobe units.
Figure 11B:
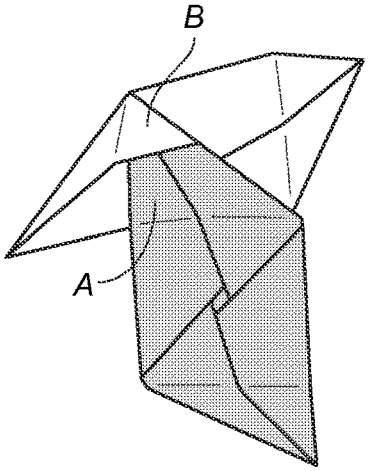
Figure 11C:
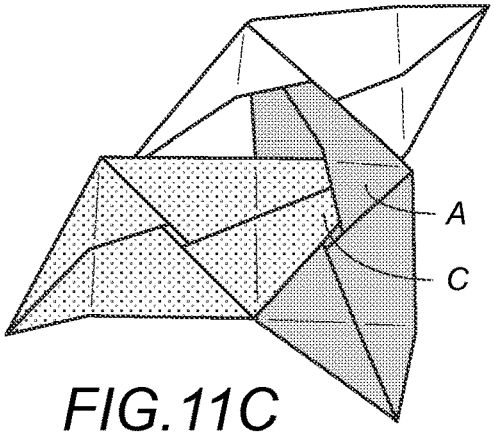
Figure 11D:
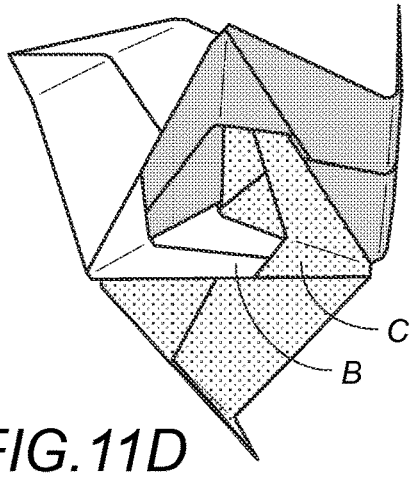
Figure 11E:
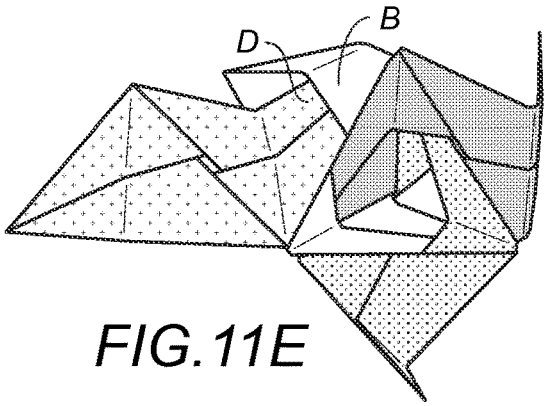
Figure 11F:
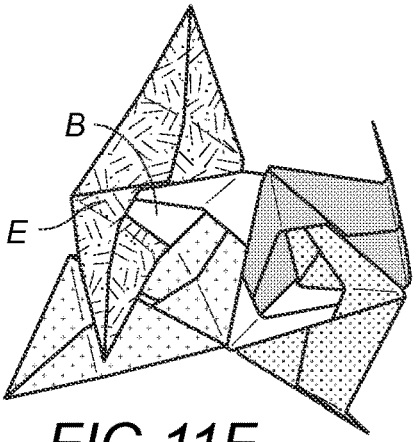
Figure 11G:
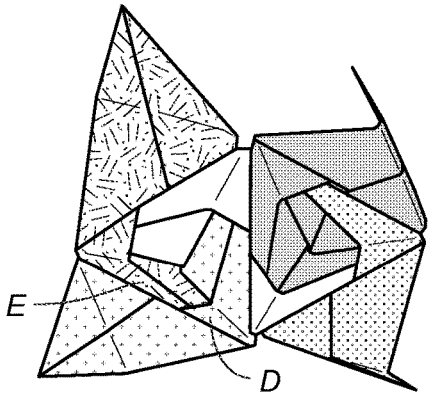
Figure 11H:
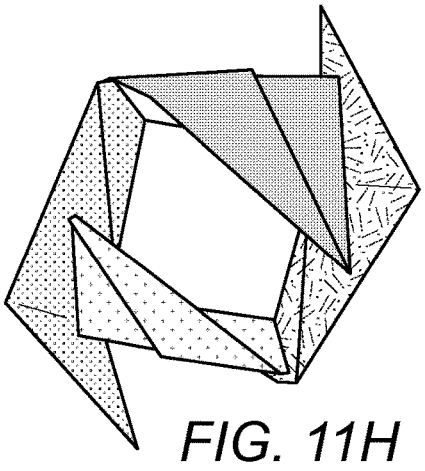
Figure 11I:
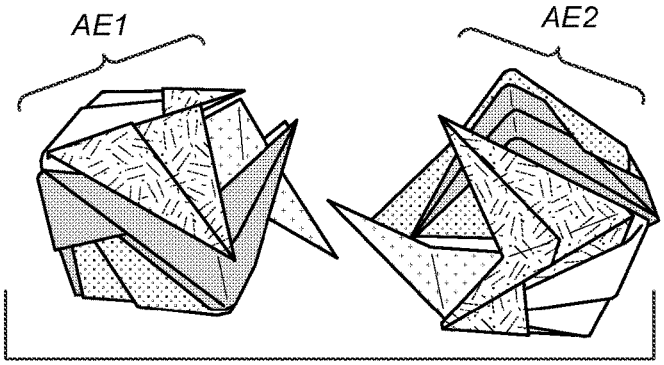
Figure 11J:
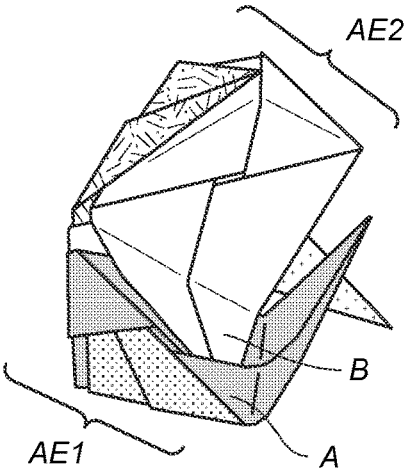
Figure 11K:
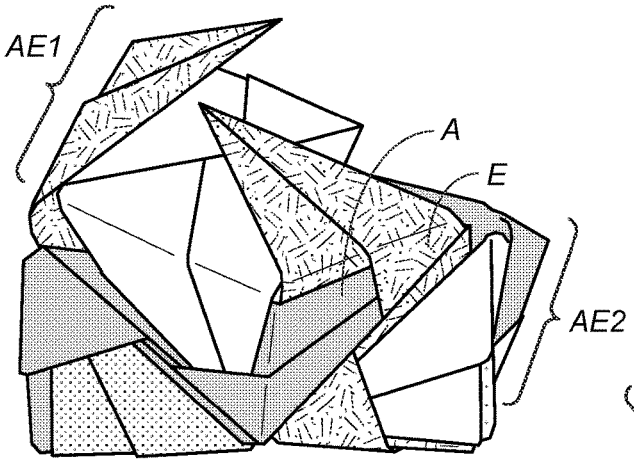
Figure 11L:
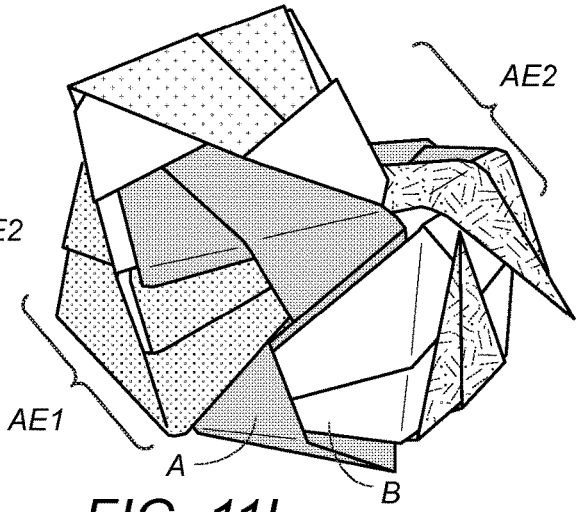
Figure 11M:
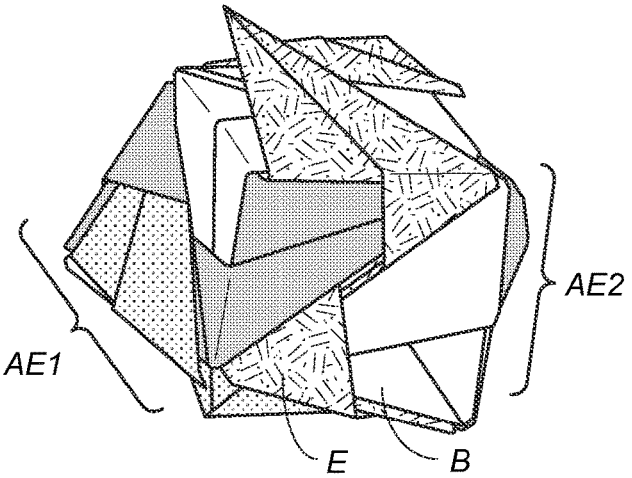
Figure 11N:
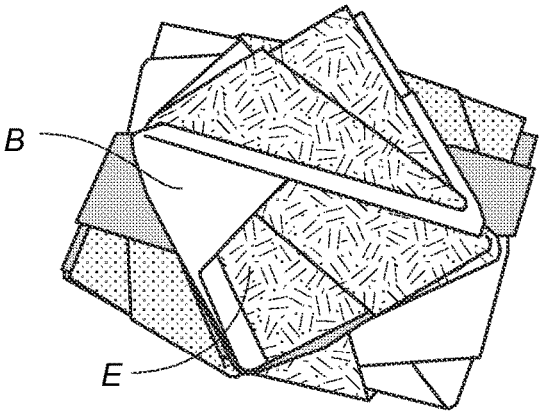
Figure 11O:
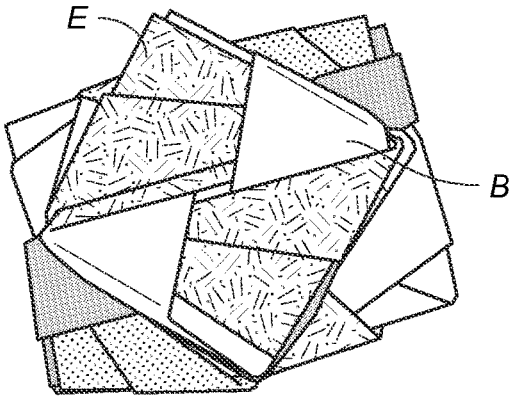
Figure 11P:
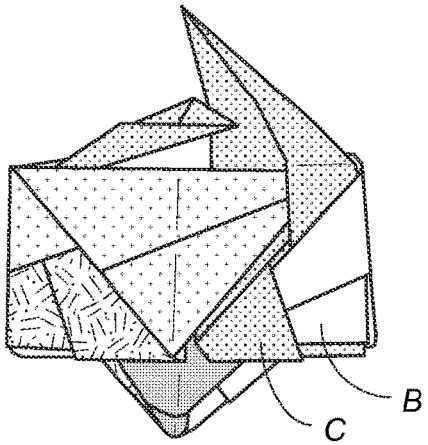
Figure 11Q:
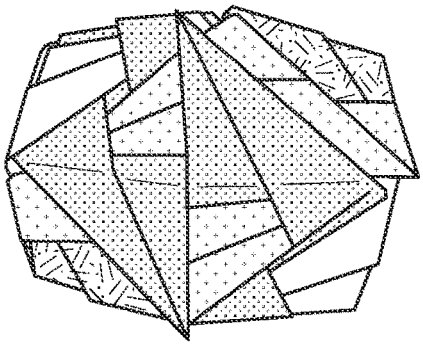
Figure 11R:
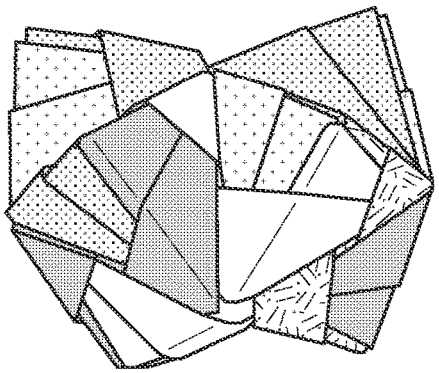

In another example, a fashion accessory can be constructed from multiple Sonobe units, including 11 units in the follow process, which incorporate 2 modular sub-assemblies of 5 units each, including: Step 1 Start with 11 units (FIG. 11A). Step 2 Tuck extension point of unit "A" into pocket of a unit "B" (FIG. 11B). Step 3 Tuck extension point of unit "C" into pocket of a unit "A" (FIG. 11C). Step 4 Tuck extension point of a unit "B" into the pocket of a unit "C" (FIG. 11D). Step 5 Tuck extension point of a unit "D" into the pocket of a unit "B" (FIG. 11E). Step 6 Tuck extension point of a unit "B" into the pocket of a unit "E" (FIG. 11F) Step 7 Tuck extension point of a unit "E" into the pocket of a unit "B" (FIG. 11G). Step 8 Fold along center and turn assembly over so that the extension points are upward (FIG. 11H). Step 9 Repeat steps 1-8 to create an identical set of units composed of units A-E, the units being denoted as AE1 and AE2 (FIG. 11I). Step 10 Tuck extension point of unit "B" of AE2 into the pocket of a unit "A" of AE1 (FIG. 11J). Step 11 Tuck extension point of unit "A" of AE1 into the pocket of a unit "E" of AE2 (FIG. 11K). Step 12 Tuck extension point of a unit "B" of AE1 into the pocket of unit "A" of AE2 (FIG. 11L). Step 13 Tuck extension point of a unit "B" of AE2 of into the pocket of a unit "E" of AE2 (FIG. 11M). Step 14 Tuck extension point of a unit "E" of AE2 into pocket of a unit "B" of AE2 (FIG. 11N). Step 15 Tuck extension point of a unit "E" of AE2 into the pocket of a unit "B" of AE2 (FIG. 11O). Step 16 Upon completion user may close construction by folding the various remaining extension points as shown (FIG. 11P-FIG. 11R).

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as may be taught or suggested herein. A variety of advantageous and disadvantageous alternatives are mentioned herein. It is to be understood that some preferred embodiments specifically include one, another, or several advantageous features, while others specifically exclude one, another, or several disadvantageous features, while still others specifically mitigate a present disadvantageous feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be mixed and matched by one of ordinary skill in this art to perform methods in accordance with principles described herein. Among the various elements, features, and steps some will be specifically included and others specifically excluded in diverse embodiments.

Although the invention has been disclosed in the context of certain embodiments and examples, it will be understood by those skilled in the art that the embodiments of the invention extend beyond the specifically disclosed embodiments to other alternative embodiments and/or uses and modifications and equivalents thereof.

Many variations and alternative elements have been disclosed in embodiments of the present invention. Still further variations and alternate elements will be apparent to one of skill in the art. Various embodiments of the invention can specifically include or exclude any of these variations or elements.

In some embodiments, the terms "a" and "an" and "the" and similar references used in the context of describing a particular embodiment of the invention (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed.

Preferred embodiments of this invention are described herein, including the best mode known to the inventors for carrying out the invention. Variations on those preferred embodiments will become apparent to those of ordinary skill in the art upon reading the foregoing description. It is contemplated that skilled artisans can employ such variations as appropriate, and the invention can be practiced otherwise than specifically described herein. Accordingly, many embodiments of this invention include all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In closing, it is to be understood that the embodiments of the invention disclosed herein are illustrative of the principles of the present invention. Other modifications that can be employed can be within the scope of the invention. Thus, by way of example, but not of limitation, alternative configurations of the present invention can be utilized in accordance with the teachings herein. Accordingly, embodiments of the present invention are not limited to that precisely as shown and described.

What is claimed is:

1. A method for constructing a bag, comprising:

providing one or more Sonobe units; and assembling the one or more Sonobe units to construct a bag, wherein assembly of the one or more Sonobe units comprises insertion of an extension point from at least one Sonobe unit into the pocket of a different Sonobe unit, fixing one or more means for attachment to the bag, wherein insertion of an extension point from at least one Sonobe unit into the pocket of a different Sonobe unit comprises at least two different Sonobe units adjacent to one another, wherein insertion of an extension point from at least one Sonobe unit into the pocket of a different Sonobe unit is repeated at least three times, and wherein at least two different Sonobe units comprises three or more Sonobe units, wherein the bag comprises an opening and an extension point from at least one Sonobe unit is a flap operably attached to the opening.

2. The method of claim 1, wherein at least two different Sonobe units are assembled to form at least two identical sub-assemblies, and the at least two identical sub-assemblies are further assembled to construct the bag.

3. The method of claim 1, further comprising folding of one or more substantially square materials into a Sonobe unit to provide the one or more Sonobe units.

4. The method of claim 1, wherein the one or more Sonobe units are each made of a flexible material capable of maintaining a fold, selected from the group consisting of leather, fabric, plastic, sheet metal, paper and cardboard.

5. The method of claim 1, wherein the at least two different Sonobe units comprise one or more Sonobe units of a particular color.

6. The method of claim 1, wherein the at least two different Sonobe units comprise one or more Sonobe units of a particular material.

7. The method of claim 1, wherein the at least two different Sonobe units comprise one or more Sonobe units of a particular pattern.

8. The method of claim 1, further comprising:

configuring the bag to possess one or more colors, one or more materials, one or more patterns, at one or more predetermined locations on the bag.

9. The method of claim 1, wherein the means for attachment comprises stitching, gluing, pins, snaps, and/or grommets.

10. The method of claim 1, wherein fixing one or more means for attachment comprises fixing at a position wherein one or more Sonobe units are co-planar.

11. The method of claim 1, further comprising:

attaching one or more ornamental features to the bag.

12. The method of claim 11, wherein the attaching of the one or more ornamental features comprises straps, handles, belts, hooks, or wheels onto the bag.

13. The method of claim 1, wherein the flap comprises a means for attaching a tip of the extension point to another Sonobe unit in a reversible manner.

14. The method of claim 13, wherein the means for attaching a tip of the extension point to another Sonobe unit in a reversible manner comprises at least one magnet.

15. The method of claim 13, wherein the means for attaching a tip of the extension point to another Sonobe unit in a reversible manner comprises a snap fitting.

16. The method of claim 13, wherein the bag comprises a strap or handle.

* * * * *